US012331444B2

(12) United States Patent
Wayment et al.

(10) Patent No.: US 12,331,444 B2
(45) Date of Patent: Jun. 17, 2025

(54) PRODUCT PACKAGING FOR SEWING EQUIPMENT

(71) Applicant: GRACEWOOD MANAGEMENT, INC., West Jordan, UT (US)

(72) Inventors: Cody Wayment, West Jordan, UT (US); Eddie Abbe, West Jordan, UT (US)

(73) Assignee: GRACEWOOD MANAGEMENT, INC., West Jordan, UT (US)

( * ) Notice: Subject to any disclaimer, the term of this patent is extended or adjusted under 35 U.S.C. 154(b) by 0 days.

(21) Appl. No.: 18/738,957

(22) Filed: Jun. 10, 2024

(65) Prior Publication Data

US 2024/0410096 A1 Dec. 12, 2024

Related U.S. Application Data

(60) Provisional application No. 63/507,666, filed on Jun. 12, 2023.

(51) Int. Cl.
*D05B 77/00* (2006.01)
*D05B 75/06* (2006.01)

(52) U.S. Cl.
CPC ..... *D05B 77/00* (2013.01); *D05B 75/06* (2013.01)

(58) Field of Classification Search
CPC ..... D05B 75/00; D05B 77/00; D05B 75/02; D05B 75/04; D05B 75/06
See application file for complete search history.

(56) References Cited

U.S. PATENT DOCUMENTS 2,891,349 A * 6/1959 Ketterer ..... D05B 77/00 112/217.1
2,958,304 A * 11/1960 Arbib ..... D05B 77/00 112/260
3,162,406 A * 12/1964 Stanton ..... D05B 77/00 312/208.6
3,286,869 A 11/1966 Krein et al.
3,741,618 A 6/1973 Newman
3,751,130 A * 8/1973 Fresard ..... D05B 77/00 312/208.6
3,781,075 A 12/1973 Fresard
3,788,716 A * 1/1974 Roberts ..... D05B 75/06 312/22
3,858,954 A * 1/1975 Hetterich ..... D05B 77/00 312/208.6

(Continued)

FOREIGN PATENT DOCUMENTS

CH 148311 A 7/1931
CN 209777230 U 12/2019

(Continued)

*Primary Examiner* — Danny Worrell
(74) *Attorney, Agent, or Firm* — Ryan L. Marshall; Jessica Kiser; Barnes & Thornburg LLP

(57) ABSTRACT

A sewing machine kit comprises a sewing machine and a wheeled base. The sewing machine includes a sewing-machine base, a sewing-machine body coupled to the sewing-machine base, and a sewing-machine head coupled to the sewing-machine body that extends from the sewing-machine body toward the sewing-machine base to define a throat of the sewing machine. The wheeled base is configured to be selectively coupled to the sewing-machine base of the sewing machine.

20 Claims, 17 Drawing Sheets

(56) References Cited

U.S. PATENT DOCUMENTS

| | | | | | |
|---|---|---|---|---|---|
| 3,927,630 | A * | 12/1975 | Saintier | D05B 75/06 | 112/217.1 |
| 4,037,549 | A * | 7/1977 | Hanyu | D05B 77/00 | 312/244 |
| 4,274,686 | A * | 6/1981 | White | D05B 75/06 | 312/22 |
| 4,423,912 | A * | 1/1984 | Daman | D05B 75/06 | 312/30 |
| 5,906,168 | A * | 5/1999 | Ito | D05B 77/00 | D15/75 |
| 10,400,375 | B2 * | 9/2019 | Gentner | D05B 91/12 | |

FOREIGN PATENT DOCUMENTS

| | | | |
|---|---|---|---|
| CN | 111017371 | A | 4/2020 |
| CN | 210479412 | U | 5/2020 |
| CN | 211520182 | U | 9/2020 |
| DE | 1757566 | U | 12/1957 |
| DE | 1757566 | A1 | 5/1971 |
| EP | 0491832 | B1 | 12/1993 |
| JP | 3310780 | B2 | 8/2002 |

* cited by examiner

PRODUCT PACKAGING FOR SEWING EQUIPMENT

CROSS-REFERENCE TO RELATED APPLICATIONS

This application claims the benefit of U.S. Provisional Application No. 63/507,666, filed Jun. 12, 2023; the entire contents of this application is hereby incorporated by reference herein.

FIELD OF THE DISCLOSURE

The present disclosure relates generally to device and methods for packaging and safely transporting quilting machines.

BACKGROUND

Devices for machine quilting typically consist of three primary components, a frame, a sewing machine, and a machine carriage having a carriage bottom plate that travels laterally on an x-axis and a carriage top plate that travels longitudinally on a y-axis.

Other devices may include an integral or separate wheeled base coupled to the sewing machine that enables the sewing machine to travel longitudinally on the y-axis. Assembling the separate wheeled base on to the sewing machine may be difficult for some users due to the size, shape, and weight of the sewing machine.

SUMMARY

The present disclosure may comprise one or more of the following features and combinations thereof.

A sewing machine kit may include a sewing machine, a wheeled base, a plurality of fasteners, and packaging. The sewing machine may include a sewing-machine base, a sewing-machine body coupled to the sewing-machine base, and a sewing-machine head coupled to the sewing-machine body that extends from the sewing-machine body toward the sewing-machine base to define a throat of the sewing machine. The wheeled base may be configured to be selectively coupled to the sewing-machine base of the sewing machine. The plurality of fasteners may be configured to selectively couple the wheeled base to the sewing-machine base of the sewing machine.

In some embodiments, the packaging may include a first carton and a second carton configured to be selectively stacked with the first carton, and an assembly tool means for supporting one of the sewing machine and the wheeled base in an assembly orientation. The first carton may have a sewing machine-receiving space configured to receive the sewing machine to support the sewing machine in a packaged orientation in which the sewing-machine body is on its side. The second carton may have a wheeled base-receiving space configured to receive the wheeled base to support the wheeled base in a packaged orientation in which wheels of the wheeled base are facing downward into the wheeled base-receiving space.

In some embodiments, the packaging may further include assembly tool means for supporting one of the sewing machine and the wheeled base in an assembly orientation. In the assembly orientation, fastener holes on the wheeled base may be aligned with fastener holes on the sewing-machine base so that a user is permitted to couple the wheeled base to the sewing-machine base with the plurality of fasteners while the one of the sewing machine and the wheeled base are fixed in the assembly orientation.

In some embodiments, the assembly tool means may be a portion of the second carton of the packaging formed to define a sewing-machine base-receiving space located within the wheeled base-receiving space. The sewing-machine base-receiving space may be configured to receive a portion of the sewing-machine base to support the sewing machine in the assembly orientation so that the sewing machine and the wheeled base are externally supported to aid the user in coupling the wheeled base to the sewing-machine body with the plurality of fasteners.

In some embodiments, the assembly tool means may be a portion of the first carton of the packaging formed to define a first cutout a portion of the second carton of the packaging formed to define a pair of wheeled base cutouts. The first cutout may open to the sewing-machine base when the sewing-machine base is in the packaged orientation. The pair of wheeled base cutout may align with the first cutout formed in the first carton when the first carton is stacked on top of the second carton and the first cutout. The pair of wheeled base cutouts may cooperate to receive the wheeled base to support the wheeled base in the assembly orientation so that the sewing machine and the wheeled base are externally supported to aid the user in coupling the wheeled base to the sewing-machine body with the plurality of fasteners.

In some embodiments, the packaging may further include an insert. The insert may be configured to selectively fit into the first cutout formed in the first carton of the packaging.

In some embodiments, the second carton of the packaging may be formed to include locating tabs. The locating tabs may extend away from a top surface of the second carton and mate with locating notches formed in the first carton of the packaging when the first carton is stacked on top of the second carton to align the first cutout in the first carton with the pair of wheeled base cutouts formed in the second carton.

In some embodiments, the packaging may further include a pair of handles. The pair of handles may be coupled to opposite sides of the first carton of the packaging. The pair of handles may be configured to assist the user in stacking the first carton on top of the second carton.

In some embodiments, the wheeled base may include a first axle, a first set of wheels, a second axle, and a second set of wheels. The first set of wheels may be coupled the first axle near opposite ends of the first axle. The second axle may be spaced apart from the first axle. The second set of wheels may be coupled to the second axle near opposite ends of the second axle.

In some embodiments, the wheeled base-receiving space may have a first section and a second section spaced apart from the first section. The first section may be configured to receive the first axle and the first set of wheels. The second section may be configured to receive the second axle and the second set of wheels.

In some embodiments, the assembly tool means may be a portion of the second carton of the packaging formed to define a sewing-machine base-receiving space. The sewing-machine base-receiving space may be located within the wheeled base-receiving space and may be configured to receive a portion of the sewing-machine base to support the sewing machine in the assembly orientation. In some embodiments, the sewing-machine base-receiving space may be located between the first section and the second section of the wheeled base-receiving space.

In some embodiments, the assembly tool means may be a portion of the first carton of the packaging and a portion of the second carton of the packaging. The portion of the first carton may be formed to define a first cutout. The portion of the second carton of the packaging may be formed to define a pair of wheeled base cutouts that align with the first cutout formed in the first carton when the first carton is stacked on top of the second carton. The first cutout and the pair of wheeled base cutouts may cooperate to receive the wheeled base to support the wheeled base in the assembly orientation.

In some embodiments, the pair of wheeled base cutouts may include a first wheeled base cutout and a second wheeled base cutout. The first wheeled base cutout may be configured to receive one end of the first axle. The second wheeled base cutout may be configured to receive one end of the second axle.

In some embodiments, the packaging further may include an insert. The insert may be configured to selectively fit into the first cutout formed in the first carton of the packaging.

In some embodiments, one of the first carton and the second carton has a fastener receiving space. The fastener receiving space may be configured to receive the plurality of fasteners.

In some embodiments, the sewing machine kit may further comprising a hand tool. The hand tool may be configured to tighten the plurality of fasteners when coupling the wheeled base to the sewing-machine base. One of the first carton and the second carton may have a hand tool receiving space configured to receive the hand tool.

In some embodiments, the packaging may further include an outer cover. The outer cover may extend around the first carton and the second carton when the first carton and the second carton are stacked together.

According to another aspect of the present disclosure, a sewing machine kit may include a sewing machine, a wheeled base, at least one fastener, and packaging. The wheeled base may be configured to be selectively coupled to a sewing-machine base of the sewing machine. The at least one fastener may be configured to selectively couple the wheeled base to the sewing-machine base of the sewing machine.

In some embodiments, the sewing machine may include a sewing-machine base, a sewing-machine body, and a sewing-machine head. The sewing-machine body may be coupled to the sewing-machine base. The sewing-machine head may be coupled to the sewing-machine body that extends from the sewing-machine body toward the sewing-machine base to define a throat of the sewing machine.

In some embodiments, the packaging may include a first carton and a second carton. The second carton may be configured to be selectively stacked with the first carton.

In some embodiments, the first carton may have a sewing machine-receiving space. The sewing machine-receiving space may be configured to receive the sewing machine to support the sewing machine in a packaged orientation in which the sewing-machine body is on its side.

In some embodiments, the second carton may have a wheeled base-receiving space and a sewing-machine base-receiving space. The wheeled base-receiving space may be configured to receive the wheeled base to support the wheeled base in a packaged orientation. In the packaged orientation, wheels of the wheeled base may be facing downward into the wheeled base-receiving space. The sewing-machine base-receiving space may be located within the wheeled base-receiving space.

In some embodiments, the sewing-machine base-receiving space may be configured to receive a portion of the sewing-machine base to support the sewing machine in an assembly orientation. In the assembly orientation, fastener holes on the wheeled base may be aligned with fastener holes on the sewing-machine base so that a user is permitted to couple the wheeled base to the sewing-machine body with the at least one fastener while the sewing machine and the wheeled base are fixed in the assembly orientation.

In some embodiments, the wheeled base may include a first axle, a first set of wheels, a second axle, and a second set of wheels. The first set of wheels may be coupled the first axle near opposite ends of the first axle. The second axle may be spaced apart from the first axle. The second set of wheels may be coupled to the second axle near opposite ends of the second axle.

In some embodiments, the wheeled base-receiving space may have a first section and a second section spaced apart from the first section. The first section may be configured to receive the first axle and the first set of wheels. The second section may be configured to receive the second axle and the second set of wheels. In some embodiments, the sewing-machine base-receiving space may be located between the first section and the second section of the wheeled base-receiving space.

In some embodiments, the sewing-machine base may include a base member, a first pair of flanges, and a second pair of flanges spaced apart from the first pair of flanges. The base member may be coupled to the sewing-machine body. The base member may be configured to be received in the sewing-machine base-receiving space of the second carton of the packaging. The first pair of flanges may extend away from opposite sides of the base member. The second pair of flanges may extend away from opposite sides of the base member. In some embodiments, the first pair of flanges of the sewing-machine base may be aligned with the first axle and the second pair of flanges may be aligned with the second axle when the base member is received in the sewing-machine base-receiving space in the assembly orientation.

In some embodiments, one of the first carton and the second carton may have a fastener receiving space. The fastener receiving space may be configured to receive the at least one fastener.

In some embodiments, the sewing machine kit may further include a hand tool. The hand tool may be configured to tighten the at least one fastener when coupling the wheeled base to the sewing-machine base and one of the first carton and the second carton has a hand tool receiving space configured to receive the hand tool.

In some embodiments, the packaging may further include an outer cover. The outer cover may extend around the first carton and the second carton when the first carton and the second carton are stacked together.

According to another aspect of the present disclosure, a method may include several steps. The method may include providing a sewing machine located in a packaged orientation in a sewing machine-receiving space formed in a first carton of packaging in which the sewing machine is on its side, a wheeled base located in a packaged orientation in a wheeled base-receiving space formed in a second carton of the packaging in which wheels of the wheeled base are facing downward into the wheeled base-receiving space, and at least one fastener located in a fastener receiving space formed in one of the first carton and the second portion of the packaging.

In some embodiments, the method may include removing the sewing machine from the sewing machine-receiving space formed in the first carton of the packaging. The method may include rotating the sewing machine from the packaged orientation to an upright orientation.

In some embodiments, the method may include inserting a sewing-machine base of the sewing machine into a base receiving space formed in the second carton of the packaging while the sewing machine is in the upright orientation so that fastener holes on the wheeled base are aligned with fastener holes on the sewing-machine base. The method may include inserting the at least one fastener into the sewing-machine base and the wheeled base to couple the wheeled base to the sewing-machine base while the sewing-machine base remains located in the sewing-machine base-receiving space to hold the sewing machine in the upright orientation.

According to another aspect of the present disclosure, a sewing machine kit may include a sewing machine, a wheeled base, at least one fastener, and packaging. The sewing machine may include a sewing-machine base, a sewing-machine body coupled to the sewing-machine base, and a sewing-machine head coupled to the sewing-machine body that extends from the sewing-machine body toward the sewing-machine base to define a throat of the sewing machine. The wheeled base may be configured to be selectively coupled to the sewing-machine base of the sewing machine. The at least one fastener may be configured to selectively couple the wheeled base to the sewing-machine base of the sewing machine.

In some embodiments, the packaging may include a first carton and a second carton configured to be selectively stacked with the first carton. The first carton may have a sewing machine-receiving space configured to receive the sewing machine to support the sewing machine in a packaged orientation in which the sewing-machine body is on its side and a first cutout that opens to the sewing-machine base when the sewing-machine base is in the packaged orientation. The second carton may have a wheeled base-receiving space configured to receive the wheeled base to support the wheeled base in a packaged orientation in which wheels of the wheeled base are facing downward into the wheeled base-receiving space and a pair of wheeled base cutouts configured to align with the first cutout formed in the first carton when the first carton is stacked on top of the second carton.

In some embodiments, the first cutout and the pair of wheeled base cutouts may cooperate when the first carton is stacked on top of the second carton to define a second wheeled base-receiving space. The second wheeled base-receiving space may be configured to receive the wheeled base to support the wheeled base in an assembly orientation. In the assembly orientation, fastener holes on the wheeled base are aligned with fastener holes on the sewing-machine base so that a user is permitted to couple the wheeled base to the sewing-machine body with the at least one fastener while the sewing machine and the wheeled base are fixed in the assembly orientation.

In some embodiments, the packaging may further includes an insert. The insert may be configured to selectively fit into the first cutout formed in the first carton of the packaging.

In some embodiments, the wheeled base may include a first axle, a first set of wheels, a second axle, and a second set of wheels. The first set of wheels may be coupled the first axle near opposite ends of the first axle. The second axle may be spaced apart from the first axle. The second set of wheels may be coupled to the second axle near opposite ends of the second axle.

In some embodiments, the wheeled base-receiving space may have a first section and a second section spaced apart from the first section. The first section may be configured to receive the first axle and the first set of wheels. The second section may be configured to receive the second axle and the second set of wheels.

In some embodiments, the pair of wheeled base cutouts may include a first wheeled base cutout and a second wheeled base cutout. The first wheeled base cut out may be configured to receive one end of the first axle. The second wheeled base cutout may be configured to receive one end of the second axle.

In some embodiments, the packaging may further include an insert. The insert may be configured to selectively fit into the first cutout formed in the first carton of the packaging. In some embodiments, one of the first carton and the second carton has a fastener receiving space configured to receive the at least one fastener.

In some embodiments, the sewing machine kit may further comprising a hand tool. The hand tool may be configured to tighten the plurality of fasteners when coupling the wheeled base to the sewing-machine base. One of the first carton and the second carton may have a hand tool receiving space configured to receive the hand tool.

In some embodiments, the packaging may further include an outer cover. The outer cover may extend around the first carton and the second carton when the first carton and the second carton are stacked together.

According to another aspect of the present disclosure, a method may include providing a sewing machine, a wheeled base, and a plurality of fasteners. The sewing machine may be located in a packaged orientation in a sewing machine-receiving space formed in a first carton of packaging in which the sewing machine is on its side. The wheeled base may be located in a packaged orientation in a wheeled base-receiving space formed in a second carton of packaging in which wheels of the wheeled base are facing downward into the wheeled base-receiving space. The plurality of fasteners may be located in a fastener receiving space formed in one of the first carton and the second portion of the packaging.

In some embodiments, the method may include removing the wheeled base from the wheeled base-receiving space formed in the second carton of the packaging. The method may include removing an insert included in the packaging from a first cutout formed in the first carton of the packing to expose a sewing-machine base while the sewing machine is in the packaged orientation.

In some embodiments, the method may include stacking the first carton of the packaging on top of the second carton of the packaging so that the first cutout aligns with a pair of wheeled base cutout formed in the second carton of the packaging to define a second wheeled base-receiving space. The method may include moving the wheeled base to an assembly orientation so that fastener holes on the wheeled base are aligned with fastener holes on the sewing-machine base.

In some embodiments, the method may include inserting the wheeled base into the second wheeled base-receiving space while the wheeled base is in the assembly orientation. The method may include inserting the plurality of fasteners into the wheeled base and the sewing-machine base to couple the wheeled base to the sewing-machine base while the wheeled base remains located in the second wheeled base-receiving space of the packaging to hold the wheeled base in the assembly orientation.

In some embodiments, the wheeled base may include a first axle, a first set of wheels, a second axle, and a second set of wheels. The first set of wheels may be coupled the first axle near opposite ends of the first axle. The second axle may be spaced apart from the first axle. The second set of wheels may be coupled to the second axle near opposite ends of the second axle.

In some embodiments, the wheeled base-receiving space may have a first section and a second section spaced apart from the first section. The first section may be configured to receive the first axle and the first set of wheels. The second section may be configured to receive the second axle and the second set of wheels.

In some embodiments, the pair of wheeled base cutouts may include a first wheeled base cutout and a second wheeled base cutout. The first wheeled base cut out may be configured to receive one end of the first axle. The second wheeled base cutout may be configured to receive one end of the second axle.

In some embodiments, inserting the wheeled base into the second wheeled base-receiving space includes inserting the first axle into the first wheeled base cutout. In some embodiments, inserting the wheeled base into the second wheeled base-receiving space includes inserting the second axle into the second wheeled base cutout.

These and other features of the present disclosure will become more apparent from the following description of the illustrative embodiments.

DETAILED DESCRIPTION OF THE DRAWINGS

Figure 1:
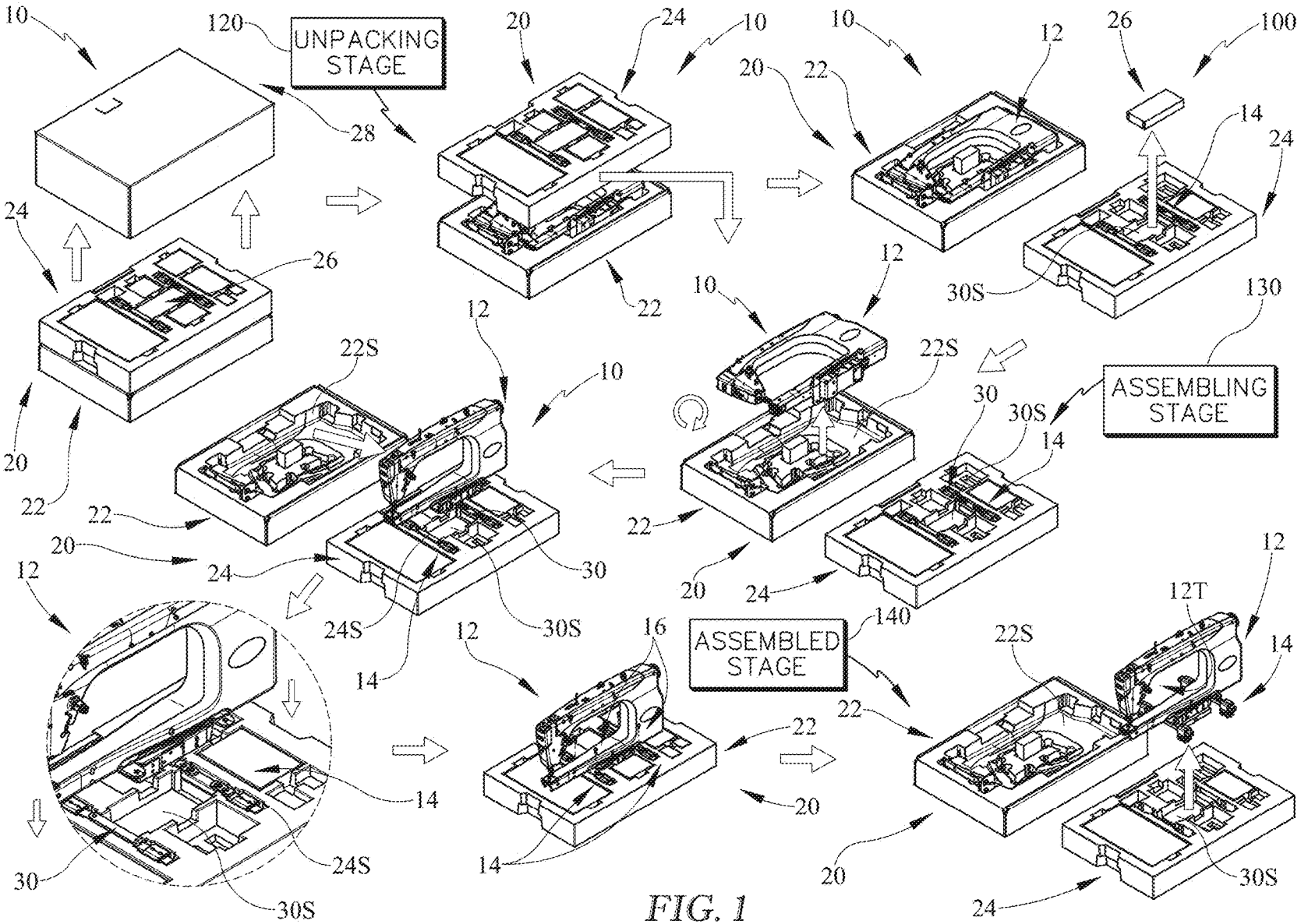
FIG. 1 is a diagrammatic view of a sewing machine assembling process showing the process includes a packaged stage in which a sewing machine and a wheeled base included in a sewing machine kit are stored in packaging; an unpacking stage in which the packaging is separated to be able to remove the sewing machine from a sewing machine-receiving space in the packaging; an assembling stage in which a sewing-machine base of the sewing machine is inserted into a base receiving space in the packaging to align fastener holes on the wheeled base with fastener holes on the sewing-machine base so that the sewing machine may be coupled to the wheeled base; and an assembled stage in which the sewing machine has been fixed to the wheeled base.

For the purposes of promoting an understanding of the principles of the disclosure, reference will now be made to a number of illustrative embodiments illustrated in the drawings and specific language will be used to describe the same.

An illustrative sewing machine kit 10 is shown in FIGS. 1-7. The sewing machine kit 10 comprises a sewing machine 12, a wheeled base 14, a plurality of fasteners 16, other assembly components 18, and packaging 20 configured contain all the other components of the sewing machine kit 10 so that the sewing machine 12, the wheeled base 14, the plurality of fasteners 16 are protected during shipment of the sewing machine kit 10.

The packaging 20 includes a first carton 22, a second carton 24, smaller containers 26, and an outer cover 28 as shown in FIGS. 1-7. The first carton 22 and the second carton 24 are configured to be selectively stacked on top of each other. The outer cover 28 is configured to extend around the first carton 22 and the second carton 24 when the first carton 22 and the second carton 24 are stacked together.

Figure 2:
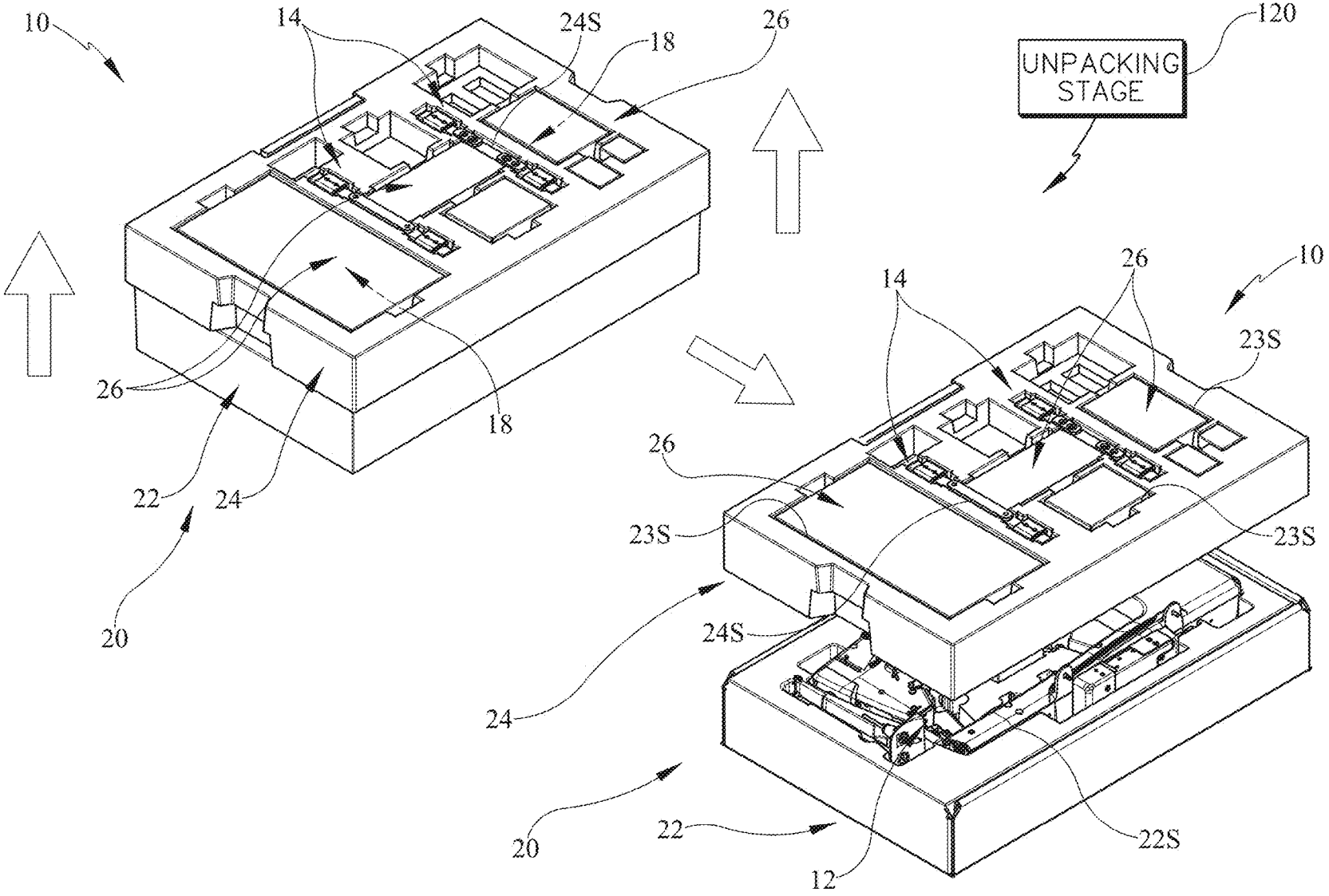
FIG. 2 is a diagrammatic view of the sewing machine kit in the unpacking stage of the assembling process of FIG. 1 showing the packaging includes a first carton and a second carton configured to be selectively stacked with the first carton, the first carton having the sewing machine-receiving space, and the second carton having a wheeled base-receiving space and the sewing-machine base-receiving space, and further showing in the unpacking stage the second carton is separated from the first carton to reveal the sewing machine.

Both the first carton 22 and carton 24 are formed to include cavities or spaces configured to receive the different components of the sewing machine kit 10 to hold them in place during shipment of the sewing machine kit 10. The first carton 22 is formed to include a sewing machine-receiving space 22S configured to receive the sewing machine 12 to support the sewing machine 12 in a packaged orientation as shown in FIG. 2. The second carton 24 is formed to include a wheeled base-receiving space 24S configured to receive the wheeled base 14 to support the wheeled base 14 in a packaged orientation as shown in FIG. 2.

Once a user receives the sewing machine kit 10, the user may have to assemble certain components. For example, the user may assemble the sewing machine 12 on the wheeled base 14 in an assembly orientation. In the assembly orientation, the wheeled base 14 is coupled to a sewing-machine base 34 of the sewing machine 12 so that the sewing machine 12 may be arranged on tracks of the frame for lateral/longitudinal movement relative to a frame assembly.

Aligning the wheeled base 14 with the sewing-machine base of the sewing machine 12 to attach the wheeled base 14 to the sewing machine 12 may be difficult for some users due to the size, shape, and weight of the sewing machine 12. This is especially true, if the user has no one to help them hold one of the sewing machine 12 or the wheeled base 14. Otherwise, the use may have to support the sewing machine 12 relative to the wheeled base 14 in the proper position while also using the fasteners 16 to fix the wheeled base 14 thereto.

Therefore, the packaging 20 includes an assembly tool means for supporting one of the sewing machine 12 and the wheeled base 14 in the assembly orientation. In the illustrative embodiment, the assembly tool 30 supports the sewing machine 12 in the assembly orientation.

In the assembly orientation, the fastener holes on the wheeled base 14 are aligned with fastener holes on the sewing-machine base 34 so that the user is permitted to couple the wheeled base 14 to the sewing-machine base 34 with the plurality of fasteners 16 while the one of the sewing machine 12 and the wheeled base 14 are fixed in the assembly orientation.

In the illustrative embodiment, the assembly tool 30 is a portion of the second carton 24 of the packaging 20 formed to define a sewing-machine base-receiving space 30S located within the wheeled base-receiving space 24S as shown in FIGS. 1 and 3-7. The sewing-machine base-receiving space 30S is configured to receive a portion of the sewing-machine base 34 to support the sewing machine 12 in the assembly orientation so that the sewing machine 12 and the wheeled base 14 are externally supported. By holding the sewing machine 12 in the assembly orientation, the assembly tool 30 aids the user in coupling the wheeled base 14 to the sewing-machine body with the plurality of fasteners 16.

Turning again to the sewing machine 12, the sewing machine 12 includes the sewing-machine base 34, a sewing-machine body 36, and the sewing-machine head 38 as shown in FIG. 2. The sewing-machine body 36 is coupled to the sewing-machine base 34. The sewing-machine head 38 is coupled to the sewing-machine body 36. The sewing-machine head 38 extends from the sewing-machine body 36 toward the sewing-machine base 34 to define a throat 12T of the sewing machine 12.

The sewing-machine base 34 includes a base member 40, a first pair of flanges 42, and a second pair of flanges 44 are spaced apart from the first pair of flanges 42 as shown in FIGS. 3-7. The base member 40 is coupled to the sewing-machine body 36 and configured to be received in the sewing-machine base-receiving space 30S of the second carton 24 of the packaging 20. The first pair of flanges 42 extend away from opposite sides of the base member 40. The second pair of flanges 44 extend away from opposite sides of the base member 40.

The wheeled base 14 has a first axle assembly 52 and a second axle assembly 54 as shown in FIGS. 3-7. The second axle assembly 54 is spaced apart from the first axle assembly 52 when the wheeled base 14 is coupled to the sewing-machine base 34. The first axle assembly 52 includes a first axle 56 and a first set of wheels 58 coupled the first axle 56 near opposite ends of the first axle 56. The second axle assembly 54 includes a second axle 60 and a second set of wheels 62 coupled to the second axle 60 near opposite ends of the second axle 60.

The first pair of flanges 42 of the sewing-machine base 34 are configured to be aligned with the first axle 56 and the second pair of flanges 44 are configured to be aligned with the second axle 60 when the base member 40 is received in the sewing-machine base-receiving space 30S. The fastener holes in the flanges 42 are aligned with fastener holes in the first axle 56, while the fastener holes in the second pair of flanges 44 are aligned with fastener holes in the second axle 60.

The packaging 20 includes the first carton 22, the second carton 24, the smaller containers 26, the outer cover 28, and the assembly tool 30 as shown in FIGS. 1-7. The first carton 22 is formed to include the sewing machine-receiving space 22S configured to receive the sewing machine 12 to support the sewing machine 12 in the packaged orientation in which the sewing machine 12 is on its side. The second carton 24 is formed to include the wheeled base-receiving space 24S configured to receive the wheeled base 14 to support the wheeled base 14 in the packaged orientation in which wheels 58, 62 of the wheeled base 14 are facing downward into the wheeled base-receiving space 24S.

In the illustrative embodiment, the second carton 24 is also formed to define the sewing-machine base-receiving space 30S. In the illustrative embodiment, one of the first carton 22 and the second carton 24 is formed to include a fastener receiving space 23S configured to receive the plurality of fasteners 16. In other embodiments, one of the first carton 22 and the second carton 24 is formed to include another receiving space 23S configured to receive the other small containers 26.

The wheeled base-receiving space 24S has a first section 52S and a second section 54S as shown in FIGS. 3-7. The first section 52S is configured to receive the first axle 56 and the first set of wheels 58. The second section 54S may be spaced apart from the first section 52S and configured to receive the second axle 60 and the second set of wheels 62.

In the illustrative embodiment, the sewing-machine base-receiving space 30S is located between the first section 52S and the second section 54S of the wheeled base-receiving space 24S. The sewing-machine base-receiving space 30S is positioned so that when the sewing machine 12 is moved from the packaged orientation to the assembly orientation, the fastener holes 42H, 44H on the sewing-machine base 34 are aligned with the fastener holes 56H, 60H on the wheeled base 14.

In the illustrative embodiment, the sewing machine kit 10 includes a hand tool (not shown) configured to tighten the plurality of fasteners 16 when coupling the wheeled base 14 to the sewing-machine base 34. The hand tool may be a screw driver, an Allen wrench, or another suitable hand tool. One of the first carton 22 and the second carton 24 has a hand tool receiving space 23S configured to receive the hand tool.

A method 100 of unpacking components of the sewing machine kit 10 and assembling the sewing machine 12 with the wheeled base 14 includes several stages. The method 100, or sewing machine 12 assembling process 100 includes a packed stage (not shown), an unpacked stage 120, an assembling stage 130, and an assembled stage 140 as shown in FIGS. 1-7.

In the packaged stage, the sewing machine 12 and the wheeled base 14 included in the sewing machine kit 10 are stored in packaging 20 in the respective packed orientations. In the packaged stage, the sewing machine 12 is located in the sewing machine-receiving space 22S, the wheeled base 24S is located in the wheeled base-receiving space 24S, and the fasteners 16 are located in the fastener receiving space 23S. Additionally, the first carton 22 is stacked with the second carton 24 while the components are in the respective packed orientations and the outer cover 28 is arranged around the first carton 22 and the second carton 24 while stacked together.

Figure 3:
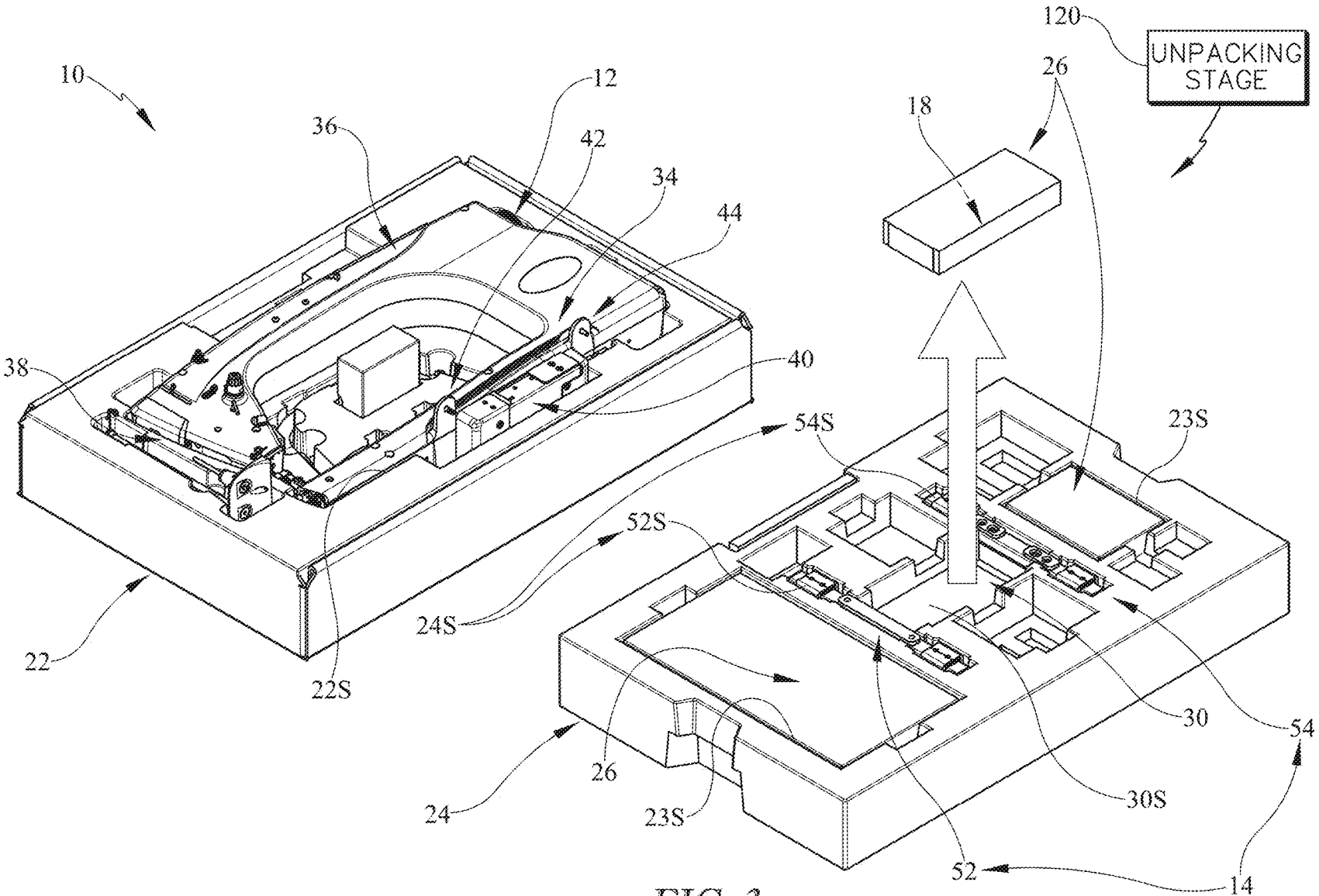
FIG. 3 is a diagrammatic view similar to FIG. 2 showing the sewing machine of the sewing machine kit includes the sewing-machine base, a sewing-machine body coupled to the sewing-machine base, and a sewing-machine head coupled to the sewing-machine body that extends from the sewing-machine body toward the sewing-machine base to define a throat of the sewing machine, and showing a portion of the packaging is removed to reveal the base receiving space formed in the second carton and configured to receive a portion of the sewing-machine base to support the sewing machine in the assembly orientation so that the sewing machine and the wheeled base are externally supported to aid the user in coupling the wheeled base to the sewing-machine body with the at least one fastener.

In the unpacking stage 120, the packaging 20 is separated to be able to remove the sewing machine 12 from the sewing machine-receiving space 22S in the packaging 20 as shown in FIGS. 1-3. In the unpacking stage 120, the second carton 24 is unstacked from the first carton 22 to reveal the sewing machine 12 as shown in FIGS. 1 and 2. Additionally, one of the other smaller packages 18 is removed from the sewing-machine base-receiving space 30S as shown in FIGS. 1 and 3.

Figure 4:
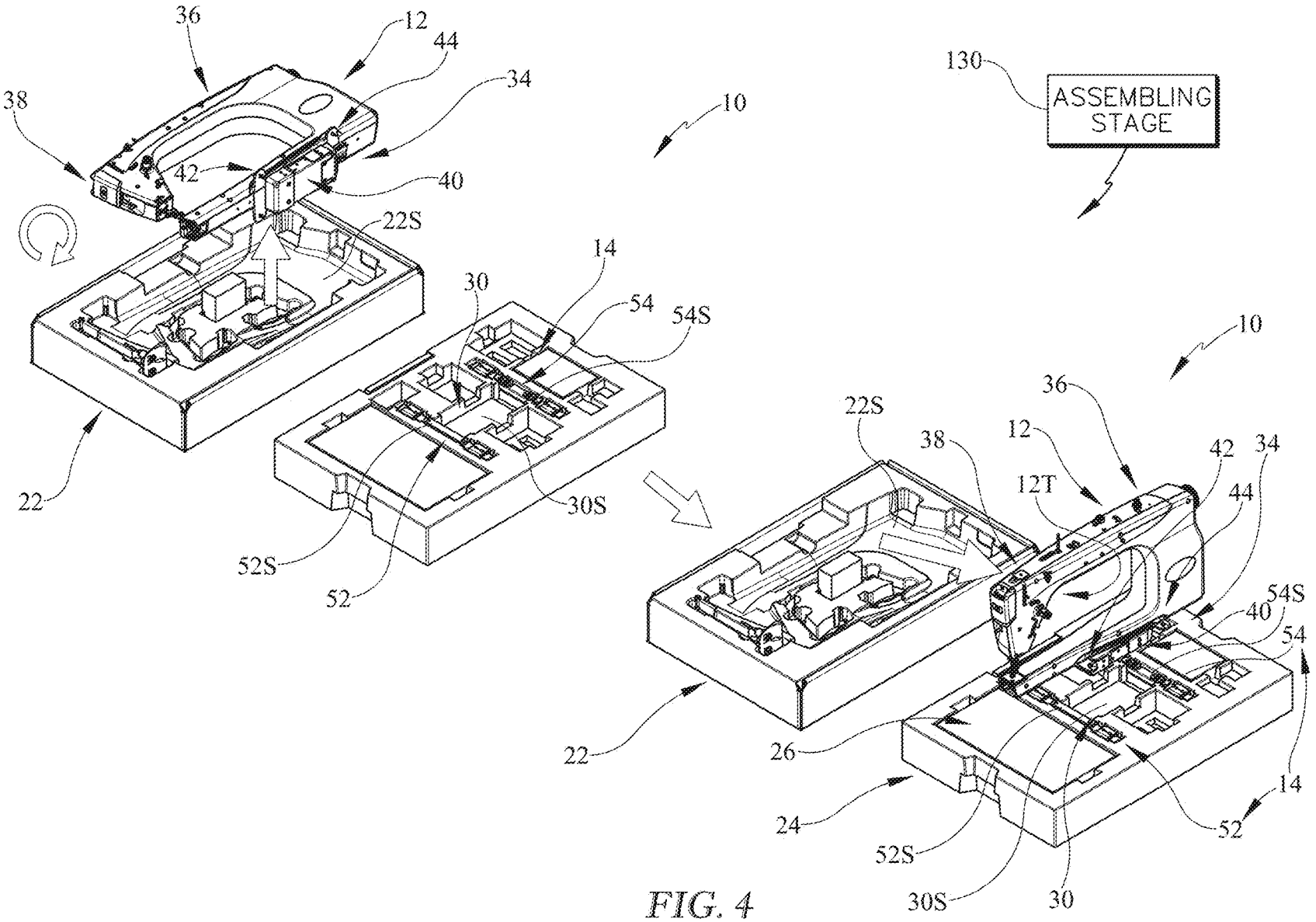
FIG. 4 is diagrammatic view of the sewing machine kit in the assembling stage of the assembling process of FIG. 1 and shows the sewing machine has been removed from the sewing machine-receiving space to begin assembling the sewing machine on the wheeled base and then rotated from a packaged orientation to an assembly or upright orientation in which the fastener holes on the wheeled base are aligned with the fastener holes on the sewing-machine base.
Figure 5:
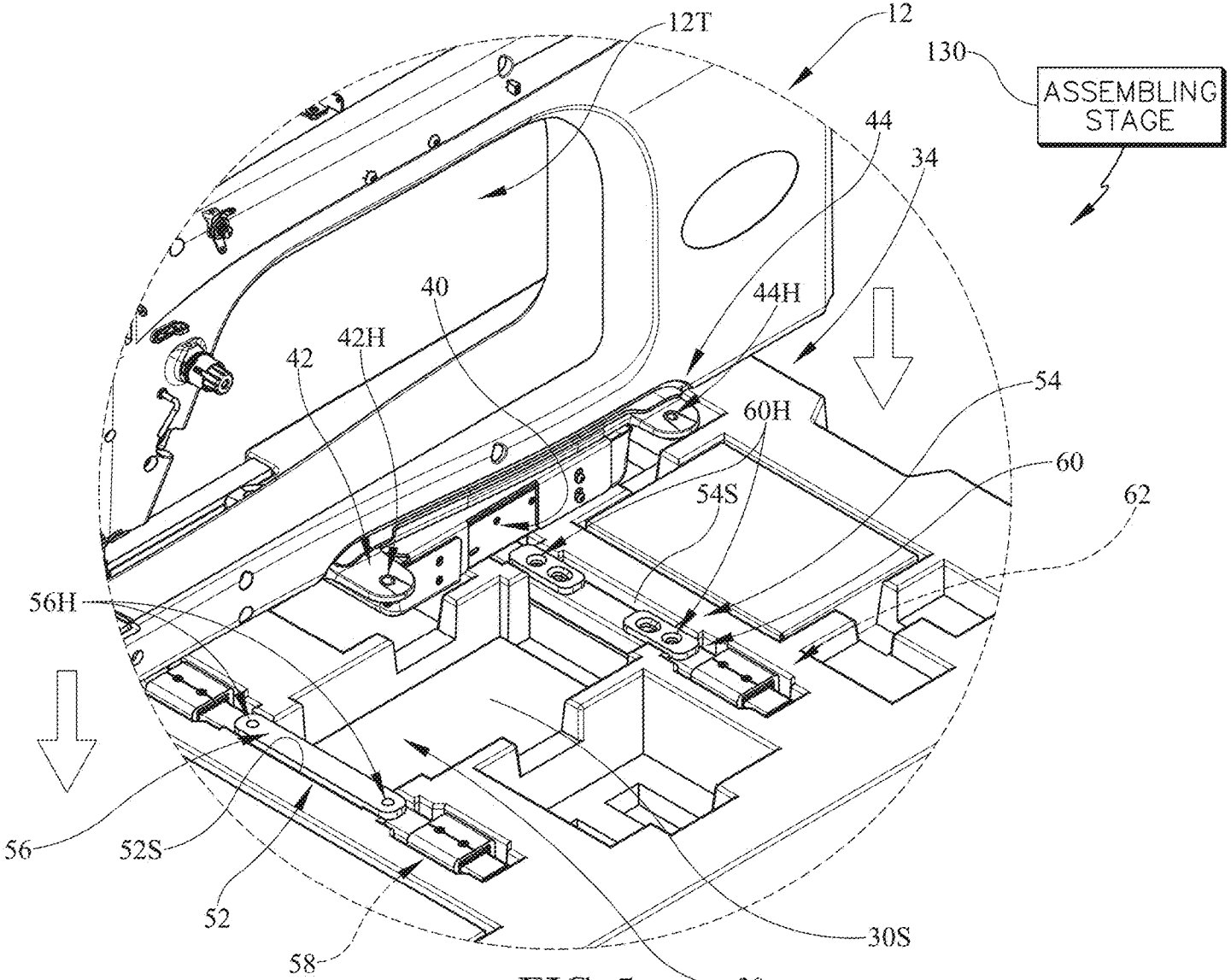
FIG. 5 is a detail view of FIG. 4 showing the sewing-machine base of the sewing machine includes a base member coupled to the sewing-machine body and configured to be received in the sewing-machine base-receiving space of the packaging, a first pair of flanges that extend away from opposite sides of the base member and align with the first axle of the wheeled base, and a second pair of flanges spaced apart from the first pair of flanges that extend away from opposite sides of the base member and align with the second axle of the wheeled base when the sewing machine is in the upright orientation.

In the assembling stage 130, the sewing-machine base 34 of the sewing machine 12 is inserted into the sewing-machine base-receiving space 30S as shown in FIGS. 1, 4, and 5. The sewing machine 12 is removed from the sewing machine-receiving space 22S of the first carton 22 and moved from the packed orientation to the assembly orientation as shown in FIGS. 1 and 4.

Figure 6:
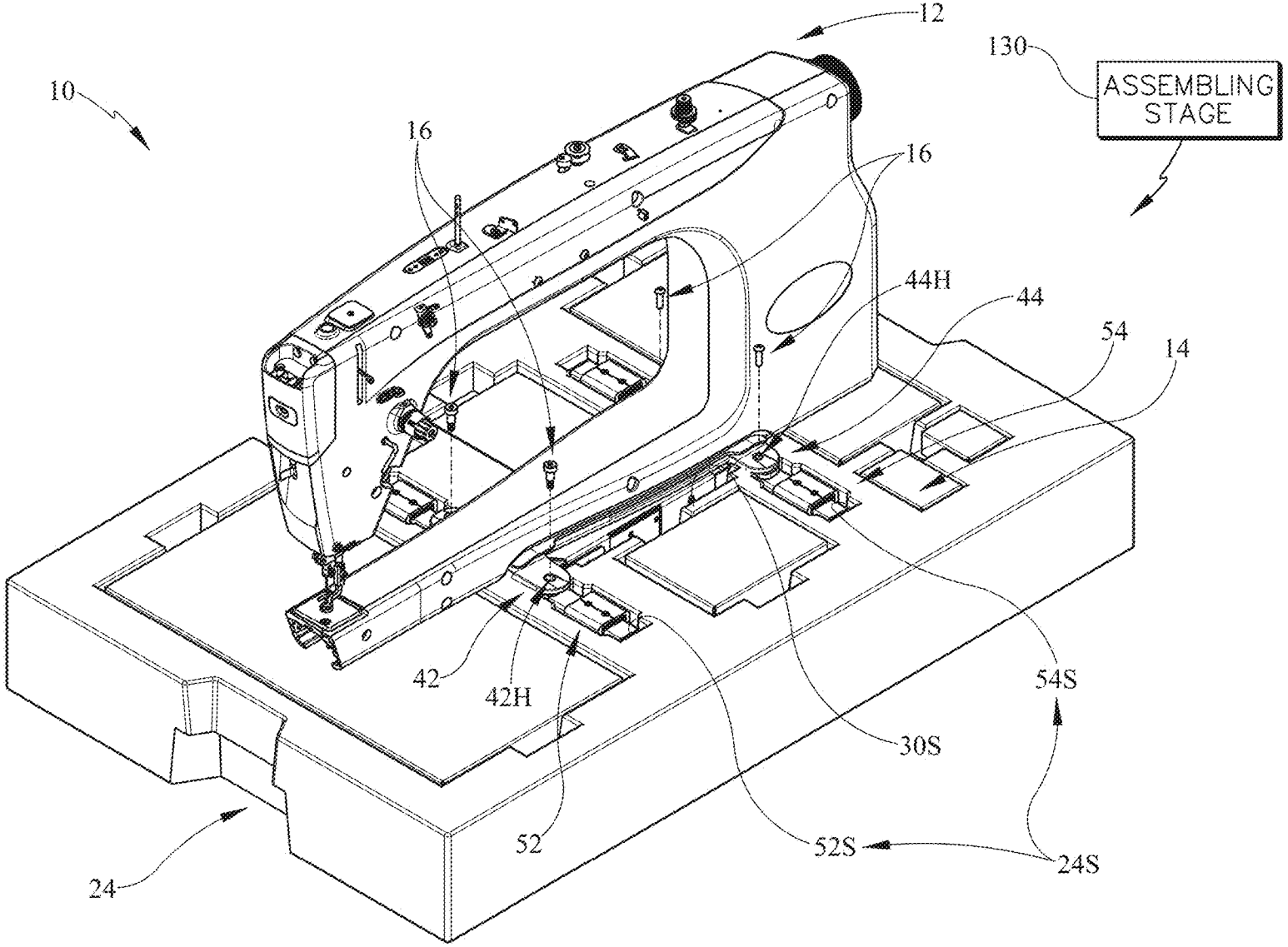
FIG. 6 is a diagrammatic view similar to FIG. 5 showing the base member of the sewing-machine base has been inserted in to the base receiving aperture so that the sewing machine is externally supported to aid a user in coupling the wheeled base to the sewing-machine body.

The sewing-machine base 34 of the sewing machine 12 is then inserted into the sewing-machine base-receiving space 30S to align fastener holes 56H, 60H on the wheeled base 14 with fastener holes 42H, 44H on the sewing-machine base 34 so that the sewing machine 12 may be coupled to the wheeled base 14 as shown in FIGS. 1, 4, and 5. The fasteners 16 are then inserted into the fasteners holes in both the sewing-machine base 34 and the wheeled base 14 while the sewing-machine base 34 remains located in the sewing-machine base-receiving space 30S to hold the sewing machine 12 in the assembly orientation, i.e. in the upright orientation as shown in FIGS. 1 and 6.

Figure 7:
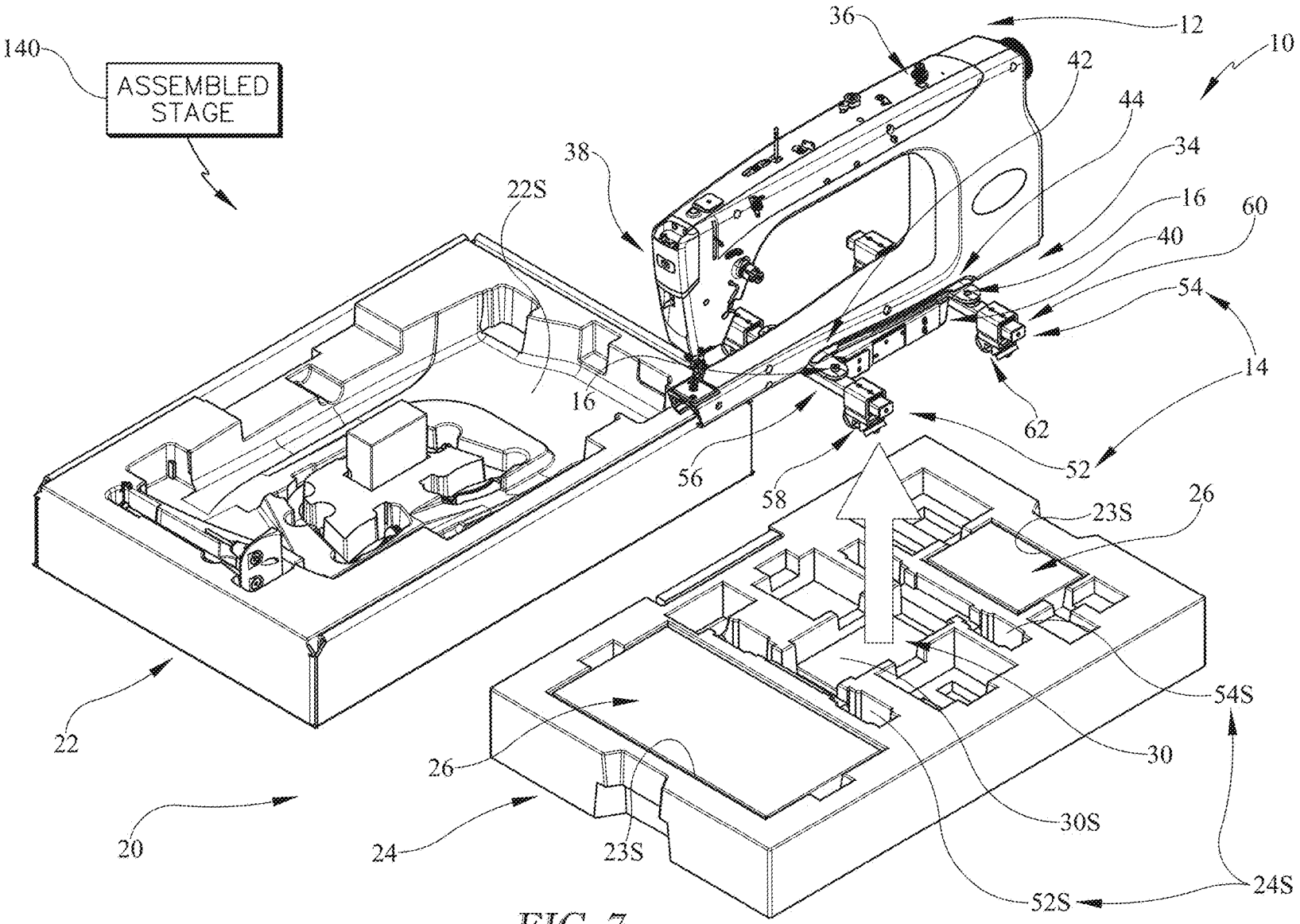
FIG. 7 is a diagrammatic view of the sewing machine kit in the assembled stage of the assembling process of FIG. 1 in which the wheeled base is fixed to the sewing machine.

In the assembled stage 140, the sewing machine 12 has been fixed to the wheeled base 14 as shown in FIGS. 1 and 7. The fasteners 16 are engaged in the fasteners holes in both the sewing-machine base 34 and the wheeled base 14. In the assembled stage 140, the sewing machine 12 and the wheeled base 14 may be removed from the packaging 20 to position the sewing machine 12 and the wheeled base 14 on the frame assembly as shown in FIGS. 1 and 7.

Another embodiment of a sewing machine kit 210 in accordance with the present disclosure is shown in FIGS. 8-17. The sewing machine kit 210 is substantially similar to the sewing machine kit 10 shown in FIGS. 1-7 and described herein. Accordingly, similar reference numbers in the 200 series indicate features that are common between the sewing machine kit 10 and the sewing machine kit 210. The description of the sewing machine kit 10 is incorporated by reference to apply to the sewing machine kit 10, except in instances when it conflicts with the specific description and the drawings of the sewing machine kit 210.

The sewing machine kit 210 comprises a sewing machine 212, a wheeled base 214, a plurality of fasteners 216, and packaging 220 as shown in FIGS. 8-11. The packaging 220 is configured contain all the other components of the sewing machine kit 210 so that the sewing machine 212, the wheeled base 214, the plurality of fasteners 216 are protected during shipment of the sewing machine kit 210.

The packaging 220 includes a first carton 222, a second carton 224, smaller containers 226, and an outer cover 228 as shown in FIGS. 8-11. The first carton 222 and the second carton 224 are configured to be selectively stacked on top of each other. The outer cover is configured to extend around the first carton 222 and the second carton 224 when the first carton 222 and the second carton 224 are stacked together.

Figure 8:
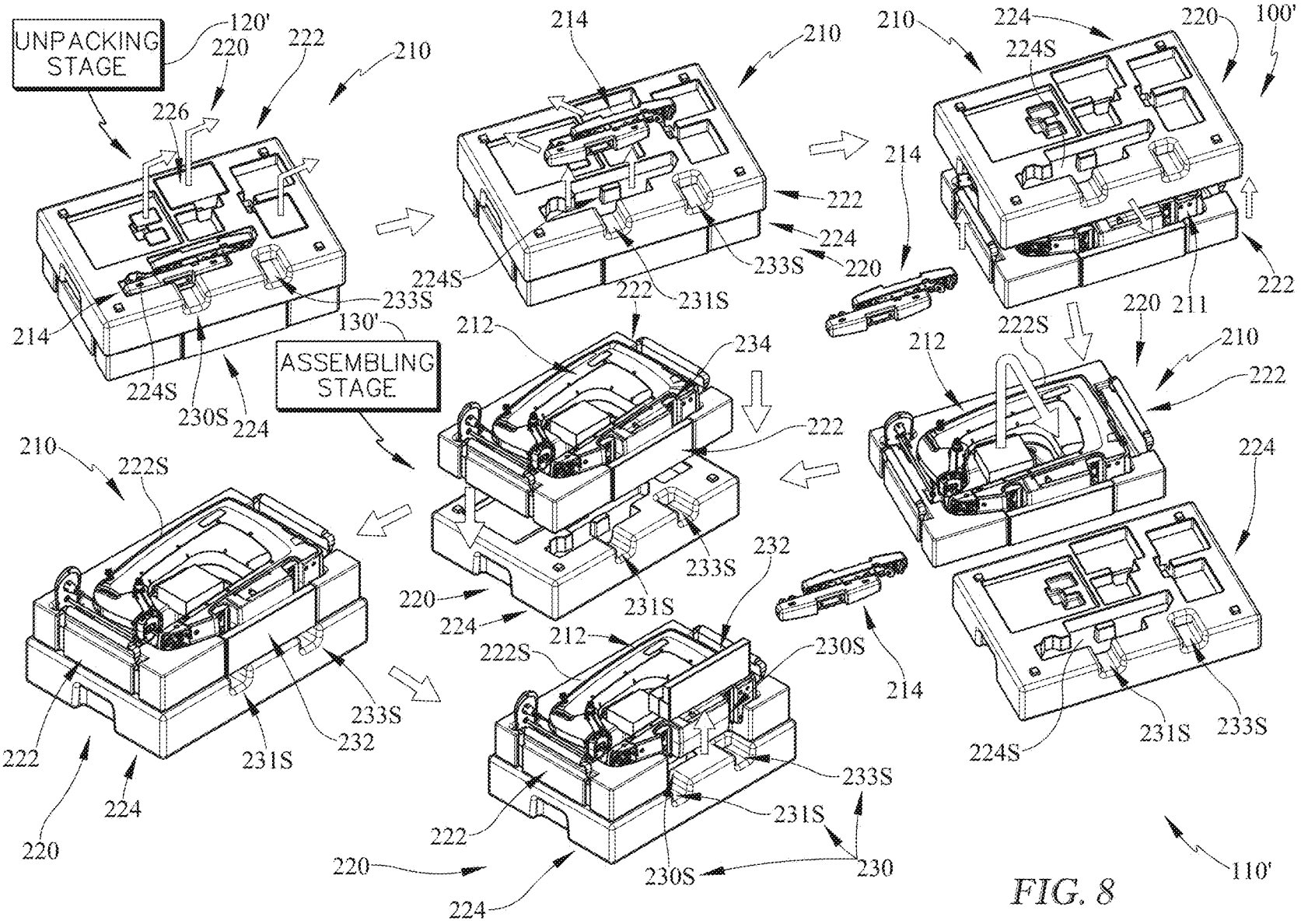
FIG. 8 is a diagrammatic view of another embodiment of a sewing machine assembling process showing the process includes a packaged stage in which a sewing machine and a wheeled base included in a sewing machine kit are stored in packaging included in the sewing machine kit; an unpacking stage in which the packaging is separated, the wheeled base is removed from a wheeled base-receiving space in the packaging, and a first carton of the packaging is stacked on top of a second carton to define a second wheeled base-receiving space; an assembling stage in which the wheeled base is inserted into the wheeled base-receiving space in the packaging to align fastener holes on the wheeled base with fastener holes on the sewing-machine base so that the sewing machine may be coupled to the wheeled base; and an assembled stage in which the sewing machine has been fixed to the wheeled base.
Figure 9:
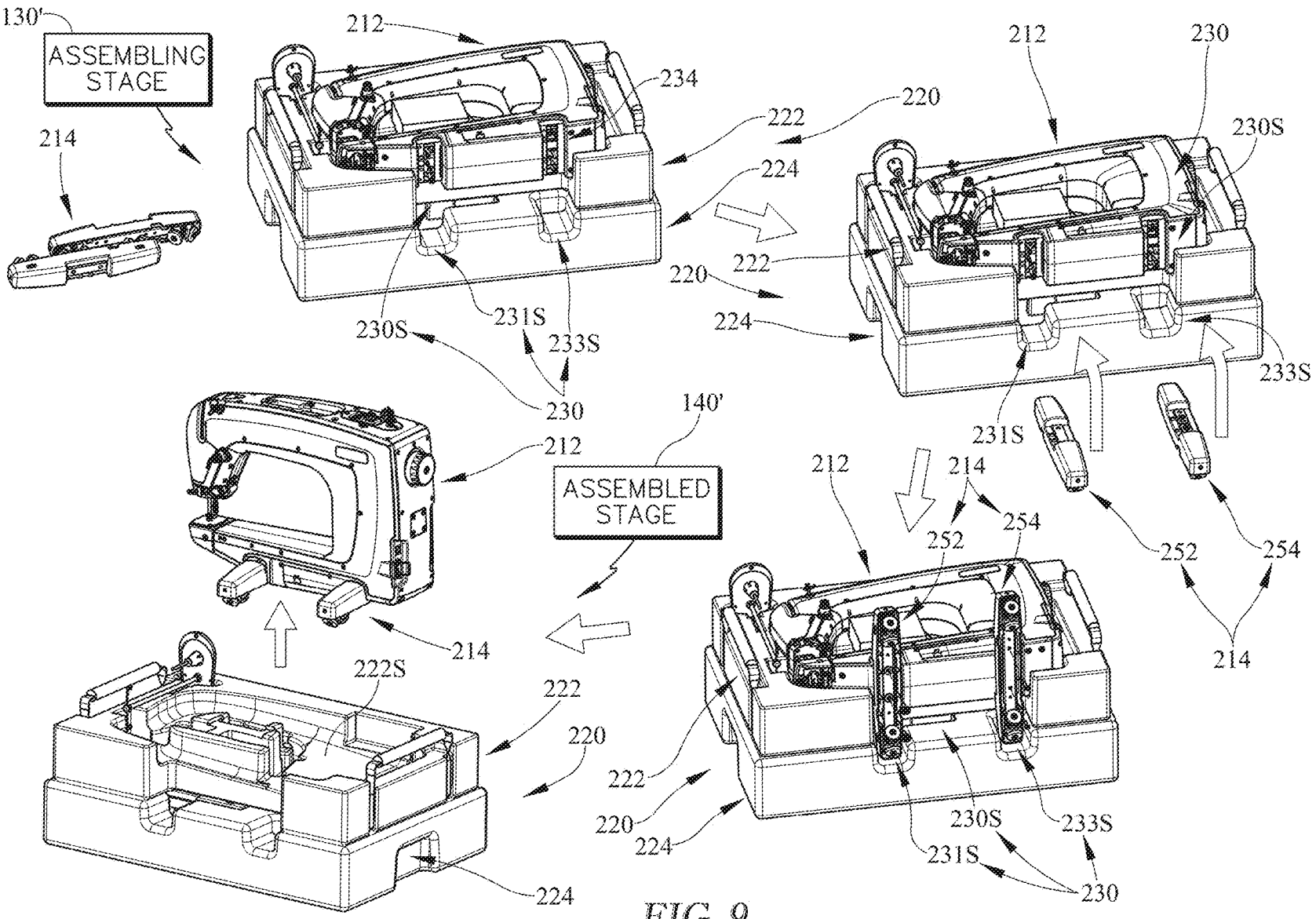
FIG. 9 is a diagrammatic view of the sewing machine kit in the unpacking stage of the assembling process of FIG. 8 showing the packaging includes a first carton and a second carton configured to be selectively stacked with the first carton, the first carton having a sewing machine-receiving space, that receives the sewing machine and the second carton having the wheeled-base receiving space, and further showing in the unpacking stage the wheeled base is removed from the wheeled base-receiving space in the second carton before the second carton is separated from the first carton to reveal the sewing machine so that the user has access to the wheeled base after the first carton is stacked on top of the second carton to define the second wheeled base-receiving space.
Figure 10:
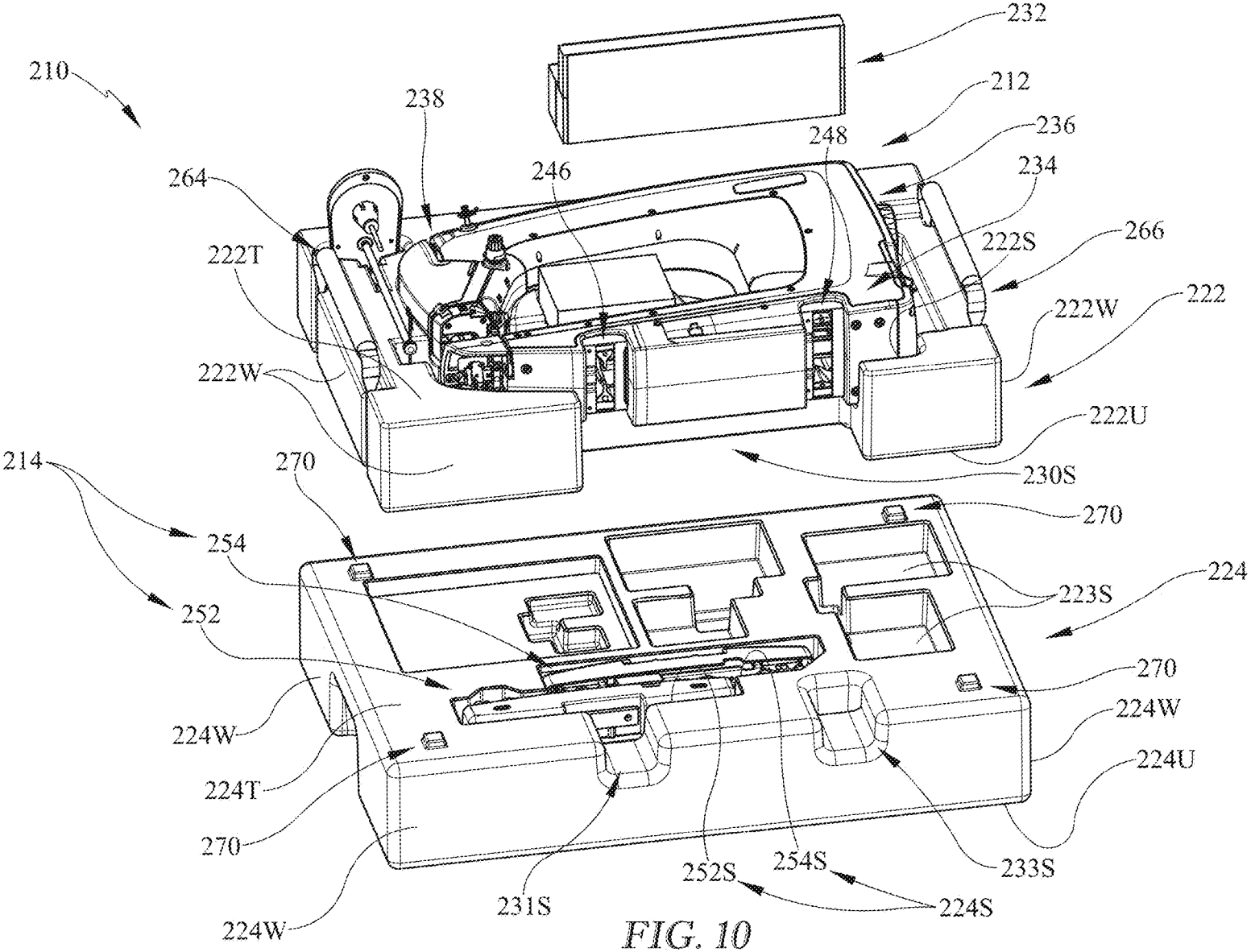
FIG. 10 is a perspective view of the sewing machine kit in the unpacking stage of the assembling process of FIG. 8 showing the first carton of the packaging is formed to define a first cutout that opens to the sewing-machine base when the sewing-machine base is in a packaged orientation and the second carton of the packaging is formed to define a pair of wheeled base cutouts that align with the first cutout formed when the first carton is stacked on top of the second carton to form the second wheeled base-receiving space, and further showing the packaging further includes an insert configured to fit into the first cutout formed in the first carton of the packaging.

Both the first carton 222 and second carton 224 are formed to include cavities or spaces configured to receive the different components of the sewing machine kit 210 to hold them in place during shipment of the sewing machine kit 210. The first carton 222 is formed to include a sewing machine-receiving space 222S configured to receive the sewing machine 212 to support the sewing machine 212 in a packaged orientation as shown in FIGS. 8-10. The second carton 224 is formed to include a wheeled base-receiving space 224S configured to receive the wheeled base 214 to support the wheeled base 214 in a packaged orientation as shown in FIGS. 8-10.

The packaging 220 includes an assembly tool means 230 for supporting one of the sewing machine 212 and the wheeled base 214 in the assembly orientation. In the illustrative embodiment, the assembly tool 230 supports the wheeled base 214 in the assembly orientation. The sewing machine 212 remains in the packaged orientation while the wheeled base 214 is attached thereto so as to aid the user in attaching the wheeled base 214 to the sewing machine 212.

In the assembly orientation, the fastener holes 256H, 260H on the wheeled base 214 are aligned with fastener holes on the sewing-machine base 234 so that the user is permitted to couple the wheeled base 214 to the sewing-machine base 234 with the plurality of fasteners 216 while the one of the sewing machine 212 and the wheeled base 214 are fixed in the assembly orientation.

In the illustrative embodiment, the assembly tool 230 is a second wheeled base-receiving space 230 that is defined by a portion of the first carton 222 of the packaging 220 formed to define a first cutout 230S and a portion of the second carton 224 of the packaging 220 formed to define a pair of wheeled base cutouts 231S, 233S as shown in FIGS. 8-11. The wheeled base cutouts 231S, 233S are configured to align with the first cutout 230S formed in the first carton 222 when the first carton 222 is stacked on top of the second carton 224 to define the second wheeled base-receiving space 224S. The first cutout 230S and the pair of wheeled base cutouts 231S, 233S cooperate to receive the wheeled base 214 to support the wheeled base 214 in the assembly orientation so that the sewing machine 212 and the wheeled base 214 are externally supported. This aids the user in coupling the wheeled base 214 to the sewing machine 212 with the plurality of fasteners 216.

Turning again to the sewing machine 212, the sewing machine 212 includes the sewing-machine base 234, a sewing-machine body 236, and the sewing-machine head 238 as shown in FIGS. 8-11. The sewing-machine body 236 is coupled to the sewing-machine base 234. The sewing-machine head 238 is coupled to the sewing-machine body 236. The sewing-machine head 238 extends from the sewing-machine body 236 toward the sewing-machine base 234.

Figure 11:
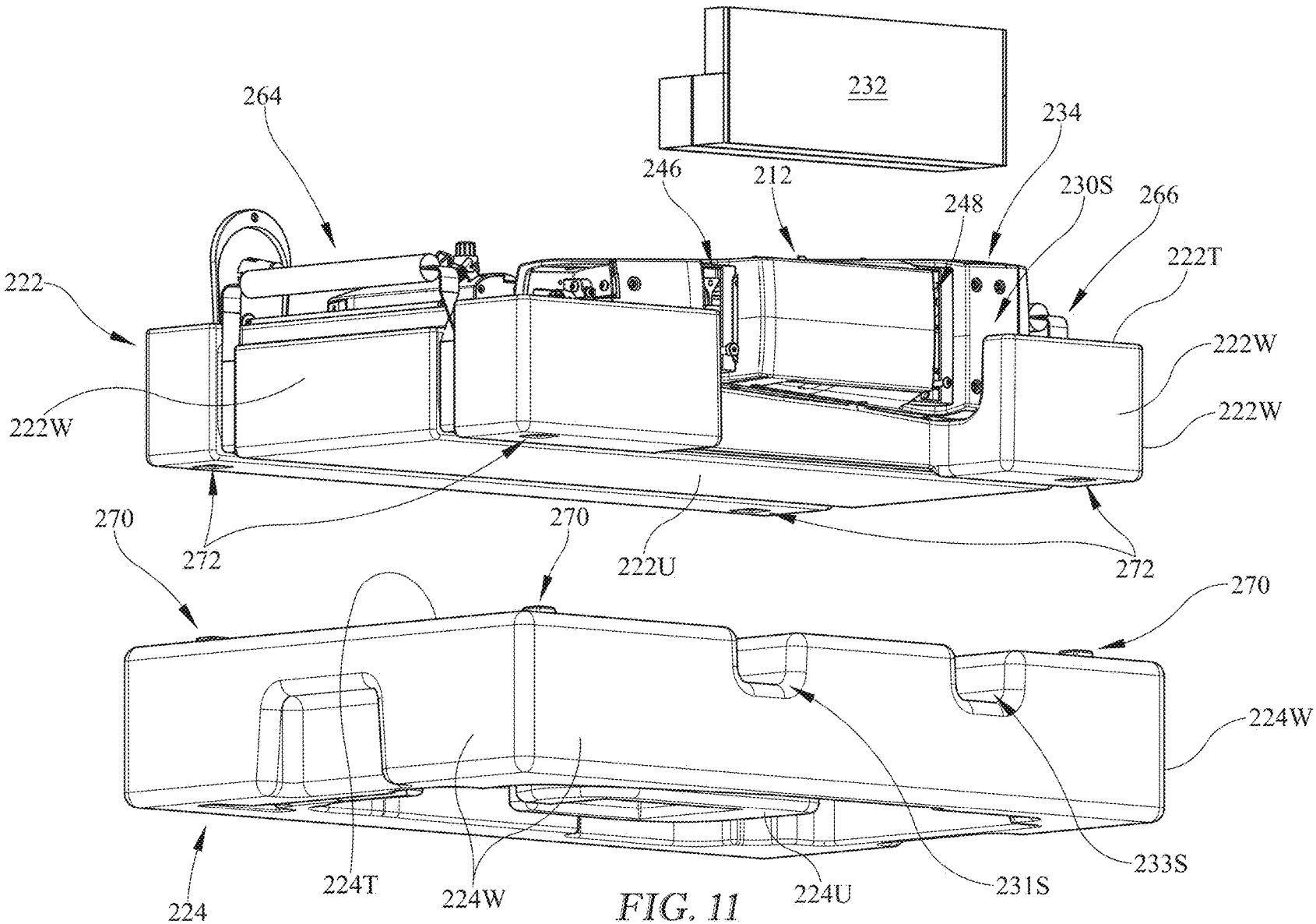
FIG. 11 is a perspective view of the sewing machine kit of FIG. 10 showing the second carton of the packaging includes a plurality of locating tabs that extend away from a top surface of the second carton and are configured to mate with locating notches formed in the first carton of the packaging when the first carton is stacked on top of the second carton to align the first cutout in the first carton with the pair of wheeled base cutouts formed in the second carton.
Figure 12:
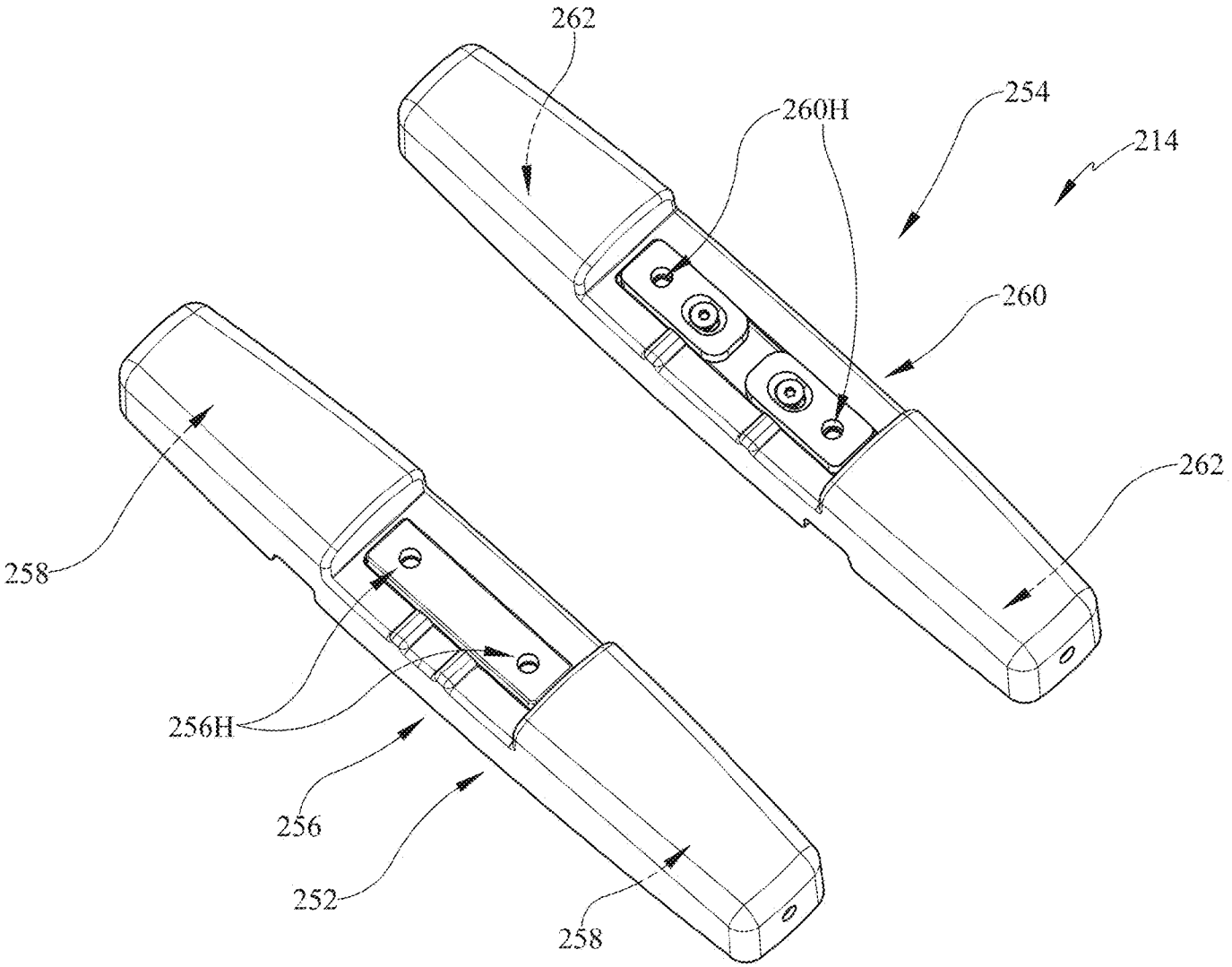
FIG. 12 is a perspective view of the wheeled base included in the sewing machine kit of FIG. 10 showing the wheeled base includes a first axle coupled to a first set of wheels and a second axle spaced apart from the first axle coupled to a second set of wheels.

The sewing-machine base 234 is formed to include a first wheel base notch 246 and a second wheel base notch 248 as shown in FIGS. 10 and 11. The second wheel base notch 248 is spaced apart from the first wheel base notch 246. Each notch 246, 248 are configured to receive a portion of the wheeled base 214.

The wheeled base 214 has a first axle assembly 252 and a second axle assembly 254 as shown in FIGS. 8-11 and 13-16. The second axle assembly 254 is spaced apart from the first axle assembly 252 when the wheeled base 214 is coupled to the sewing-machine base 234. The first axle assembly 252 includes a first axle 256 and a first set of wheels 258 coupled the first axle 256 near opposite ends of the first axle 256. The second axle assembly 254 includes a second axle 260 and a second set of wheels 262 coupled to the second axle 260 near opposite ends of the second axle 260.

The first axle assembly 252 mates with the sewing-machine base 234 in the first wheeled base notch 246, while the second axle assembly 253 mates with the sewing-machine base 234 in the second wheeled base notch 248 in the illustrative embodiment. The first wheeled base notch 246 is configured to be aligned with the first axle 56 and the second wheeled base notch 248 is configured to be aligned with the second axle 60 when the first axle assembly 252 and the second axle assembly 254 are located in the respective wheeled base cutouts 231S, 233S.

The packaging 220 includes the first carton 222, the second carton 224, the smaller containers 226, the outer cover, and the assembly tool 230 as shown in FIGS. 8-11. The first carton 222 is formed to include the sewing machine-receiving space 222S configured to receive the sewing machine 212 to support the sewing machine 212 in the packaged orientation in which the sewing machine 212 is on its side. The second carton 224 is formed to include the wheeled base-receiving space 224S configured to receive the wheeled base 214 to support the wheeled base 214 in the packaged orientation in which wheels 258, 262 of the wheeled base 214 are facing downward into the wheeled base-receiving space 224S.

The assembly tool 230 is provided by the first cutout 230S and the pair of wheeled base cutouts 231S, 233S as shown in FIGS. 8-11. The first cutout 230S is formed in the first carton 222 and opens to the sewing-machine base 234 when the sewing machine 212 is in the packaged orientation. The pair of wheeled base cutouts 231S, 233S align with the first cutout 230S formed in the first carton 222 when the first carton 222 is stacked on top of the second carton 224. The first cutout 230S and the pair of wheeled base cutouts 231S, 233S cooperate to receive the wheeled base 214 to support the wheeled base 214 in the assembly orientation so that the sewing machine 212 and the wheeled base 214 are externally supported to aid the user in coupling the wheeled base 214 to the sewing-machine body 236 with the plurality of fasteners 216.

In the illustrative embodiment, the packaging 220 further includes an insert 232 as shown in FIGS. 10 and 11. The insert 232 is configured to selectively fit into the first cutout 230S formed in the first carton 222 of the packaging 220. The insert 232 is configured to be removed from the first cutout 230S before the assembly tool 230 is used to attach the wheeled base 214 to the sewing machine 212.

In the illustrative embodiment, the packaging 220 further includes a pair of handles 264, 266 as shown in FIGS. 10 and 11. The pair of handles 264, 266 are coupled to opposite sides of the first carton 222 of the packaging 220. The handles 264, 266 are configured to assist the user in stacking the first carton 222 on top of the second carton 224.

The first carton 222 has a topside 222T, an underside 222U opposite the topside 222T, and a plurality of sidewalls 222W that extend between the topside 222T and the underside 222U as shown in FIGS. 10 and 11. The topside 222T is formed to include the sewing machine-receiving space 222S. The first cutout 230S is formed in one of the sidewalls 222W of the first carton 222 and opens into the sewing machine-receiving space 222S.

The second carton 224 has a topside 224T, an underside 224U opposite the topside 224T, and a plurality of sidewalls 224W that extend between the topside 224T and the underside 224U as shown in FIGS. 10 and 11. The topside 224T is formed to include the wheeled base-receiving space 224S.

The wheeled base-receiving space 224S has a first section 252S and a second section 254S as shown in FIG. 10. The first section 252S is configured to receive the first axle 256 and the first set of wheels 258. The second section 254S may be spaced apart from the first section 252S and configured to receive the second axle 260 and the second set of wheels 262.

In the illustrative embodiment, the second carton 224 of the packaging 220 is formed to include locating tabs 270 as shown in FIGS. 10 and 11. The locating tabs 270 extend away from a top surface of the topside 224T of the second carton 224. The locating tabs 270 mate with locating notches 272 formed in the underside 222U of the first carton 222 of the packaging 220 when the first carton 222 is stacked on top of the second carton 224. The locating tabs 270 and locating notches 272 cooperate to align the first cutout 230S in the first carton 222 with the pair of wheeled base cutouts 231S, 233S formed in the second carton 224.

A method 100' of unpacking components of the sewing machine kit 210 and assembling the sewing machine 212 with the wheeled base 214 includes several stages. The method 100', or sewing machine 212 assembling process 100' includes a packed stage (not shown), an unpacked stage 120', an assembling stage 130', and an assembled stage 140' as shown in FIGS. 8-17.

In the packaged stage, the sewing machine 212 and the wheeled base 214 included in the sewing machine kit 210 are stored in packaging 220 in the respective packed orientations. In the packed stage, the sewing machine 212 is located in the sewing machine-receiving space 222S, the wheeled base 224S is located in the wheeled base-receiving space 224S, and the fasteners 216 are located in the fastener receiving space 223S. Additionally, the first carton 222 is stacked with the second carton 224 while the components are in the respective packed orientations and the outer cover is arranged around the first carton 222 and the second carton 224 while stacked together.

In the unpacking stage 120', the wheeled base 214 is removed from the wheeled base-receiving space 224S formed in the second carton 224 of the packaging 220 as shown in FIG. 8. The smaller containers 226 may also be removed from the second carton 224 before the first carton 222 is stacked on top of the second carton 224. In the unpacking stage 120', the packaging 220 is separated to be able to reveal the sewing machine 212 located in the sewing machine-receiving space 222S. In the unpacking stage 120', the second carton 224 is unstacked from the first carton 222 to reveal the sewing machine 212 as shown in FIG. 8.

Next, the first carton 222 of the packaging 220 is stacked on top of the second carton 224 of the packaging 224 during the assembling stage 130' as shown in FIG. 8. In the assembling stage 130', the first carton 222 is stacked on top of the second carton 224 so that the first cutout 230S aligns with the pair of wheeled base cutouts 231S, 233S formed in the second carton 224 of the packaging 220 to define the second wheeled base-receiving space 230 or the assembly tool 230. In the illustrative embodiment, the first carton 222 is stacked on top of the second carton 224 so that the locating tabs 270 on the second carton 224 mate with the locating notches 272 on the second carton 224.

In some embodiments, the assembling stage 130' may further include removing the insert 232 included in the packaging 230 from the first cutout 230S formed in the first carton 222 of the packing 220 to expose the sewing-machine base 234 while the sewing machine 212 is in the packaged orientation as shown in FIG. 8. The insert 232 may be removed before or after the first carton 222 is stacked on top of the second carton 224.

Once the sewing-machine base 234 is exposed, the assembling stage 130' of the method 100' includes moving the wheeled base 214 to the assembly orientation as shown in FIGS. 9 and 13-16. The wheeled base 214 is moved to the assembly orientation so that fastener holes 256H, 260H on the wheeled base 214 are aligned with fastener holes on the sewing-machine base 234 as shown in FIGS. 13-16. Next, the wheeled base 214 is inserted into the second wheeled base-receiving space 230 while the wheeled base 214 is in the assembly orientation during the assembling stage 130' as shown in FIGS. 9 and 13-16. Further, the plurality of fasteners 216 are then inserted into the wheeled base 214 and the sewing-machine base 234 to couple the wheeled base 214 to the sewing-machine base 234 while the wheeled base 214 remains located in the second wheeled base-receiving space 230 of the packaging 220 to hold the wheeled base 214 in the assembly orientation as shown in FIGS. 9 and 13-16.

Figure 13:
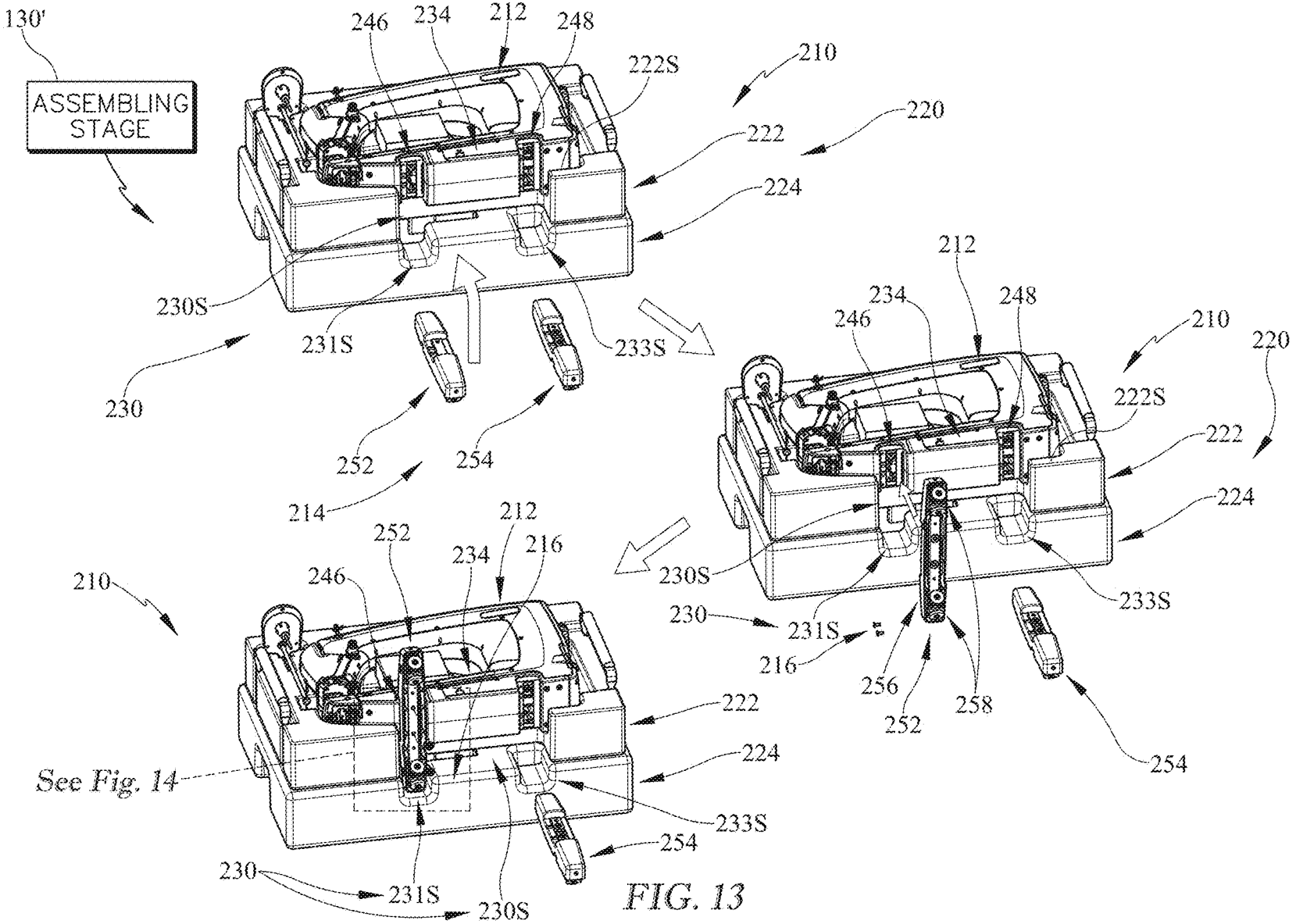
FIG. 13 is a diagrammatic view of the sewing machine kit in the assembling stage of the assembling process of FIG. 8 showing the first axle with the first set of wheels is first rotated from a packaged orientation to an assembly orientation in which the fastener holes on the first axle are aligned with the fastener holes on the sewing-machine base and then inserted into the second wheeled base-receiving space so that the first axle and the first set of wheels are supported in the assembly orientation.
Figure 14:
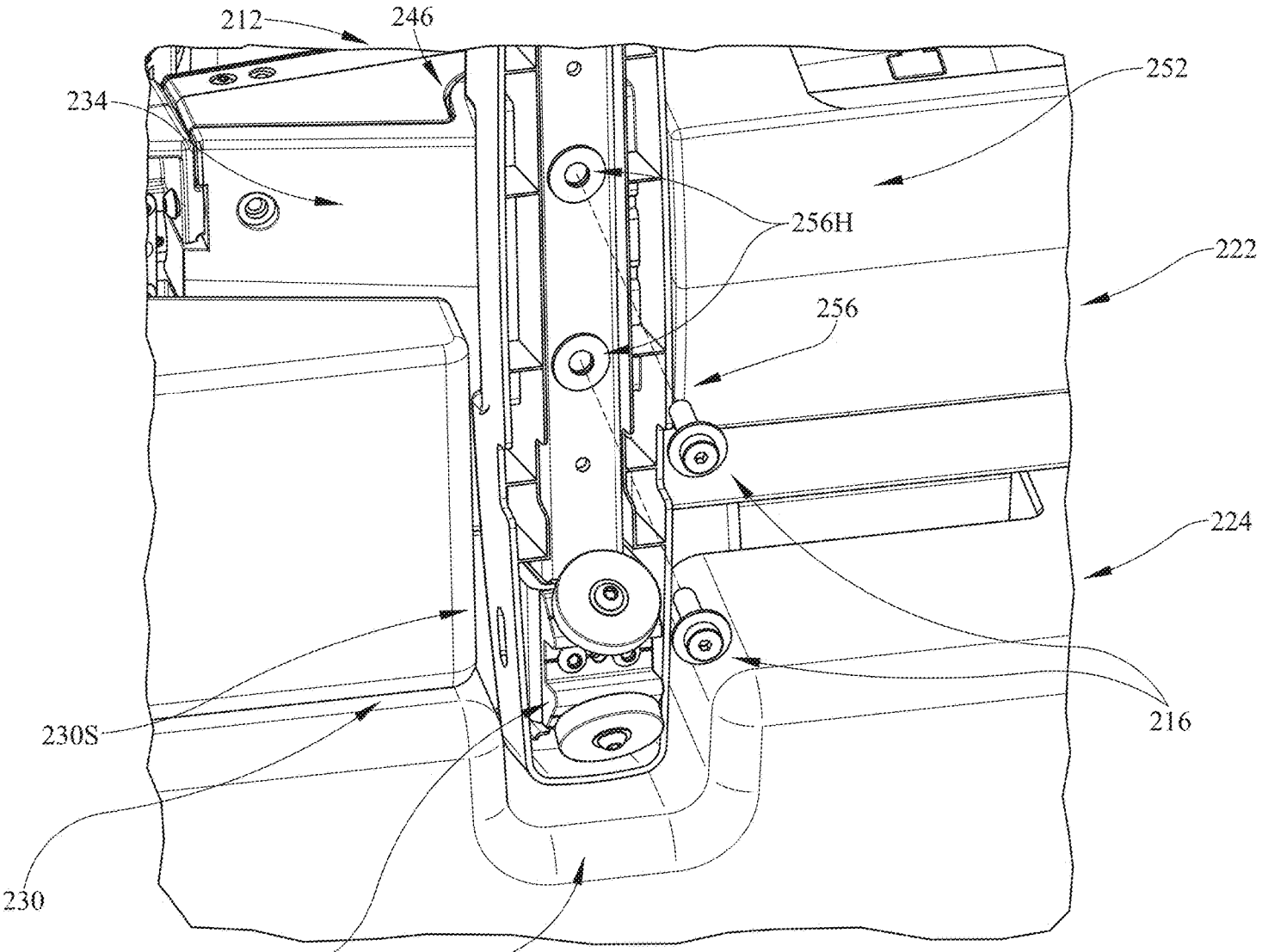
FIG. 14 is a diagrammatic view of the sewing machine kit of FIG. 13 after the first axle is rotated and inserted showing the fasteners are configured to be inserted through the first axle into the sewing-machine base while the first axle is supported in the assembly orientation.

In the illustrative embodiment, each of the first and second axle assemblies 252, 254 are moved to the assembly orientation and inserted into the second wheeled base-receiving space 230 separately as shown in FIGS. 13-16. The first axle assembly 252 is moved to the assembly orientation so that fastener holes 256H on the first axle assembly 252 are aligned with fastener holes in the first wheel base notch 246 on the sewing-machine base 234 as shown in FIG. 13. The first axle assembly 252 is then inserted into the second wheeled base-receiving space 230 while the first axle assembly 252 is in the assembly orientation so that one end of the first axle assembly 252 is located in the first wheel base cutout 231S as shown in FIG. 13. The fasteners 216 are then inserted into the first axle assembly 252 and the sewing-machine base 234 as shown in FIG. 14.

Figure 15:
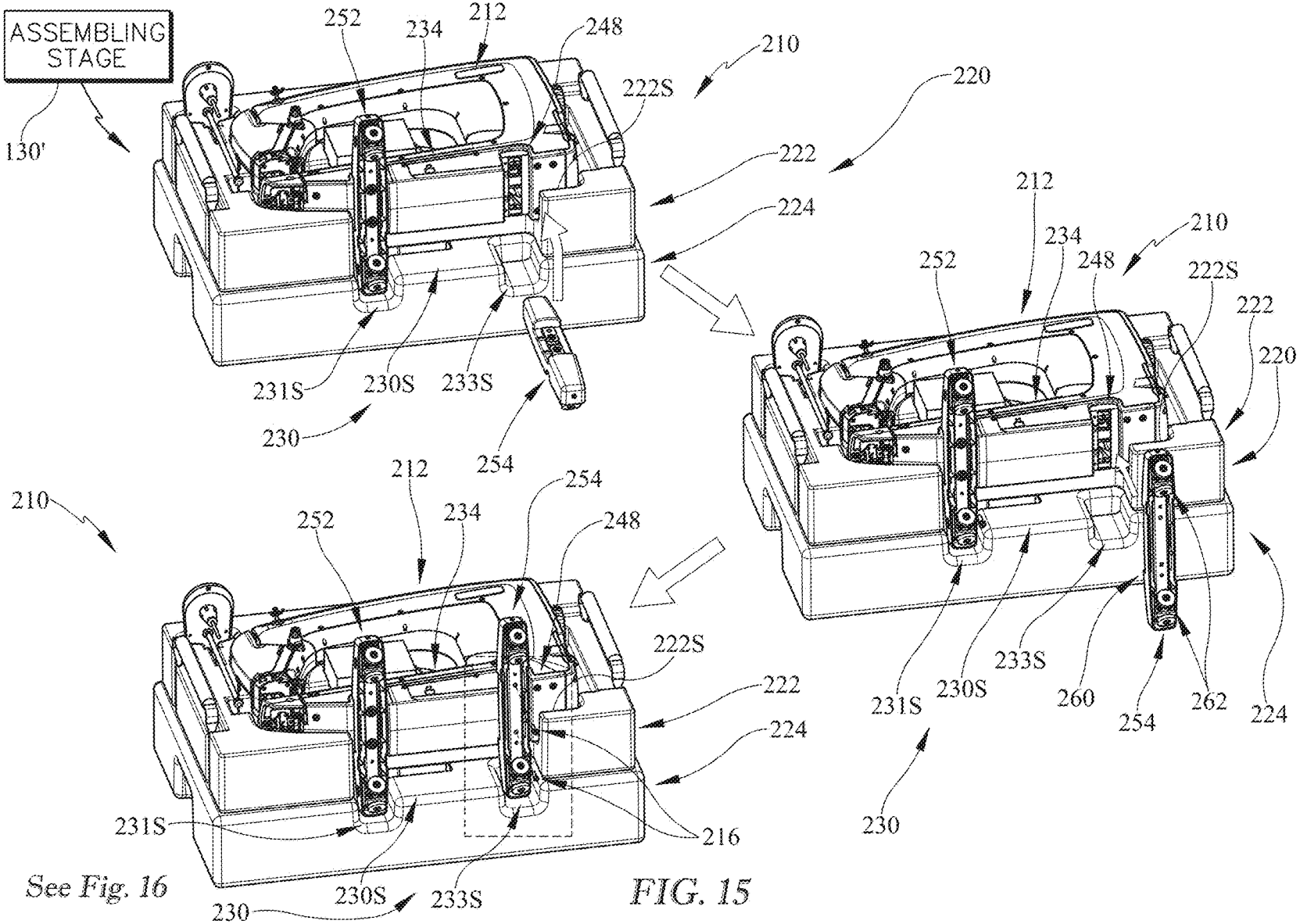
FIG. 15 is a diagrammatic view similar to FIG. 13 showing the second axle with the second set of wheels is first rotated from the packaged orientation to the assembly orientation in which the fastener holes on the second axle are aligned with the fastener holes on the sewing-machine base and then inserted into the second wheeled base-receiving space so that the second axle and the second set of wheels are supported in the assembly orientation.
Figure 16:
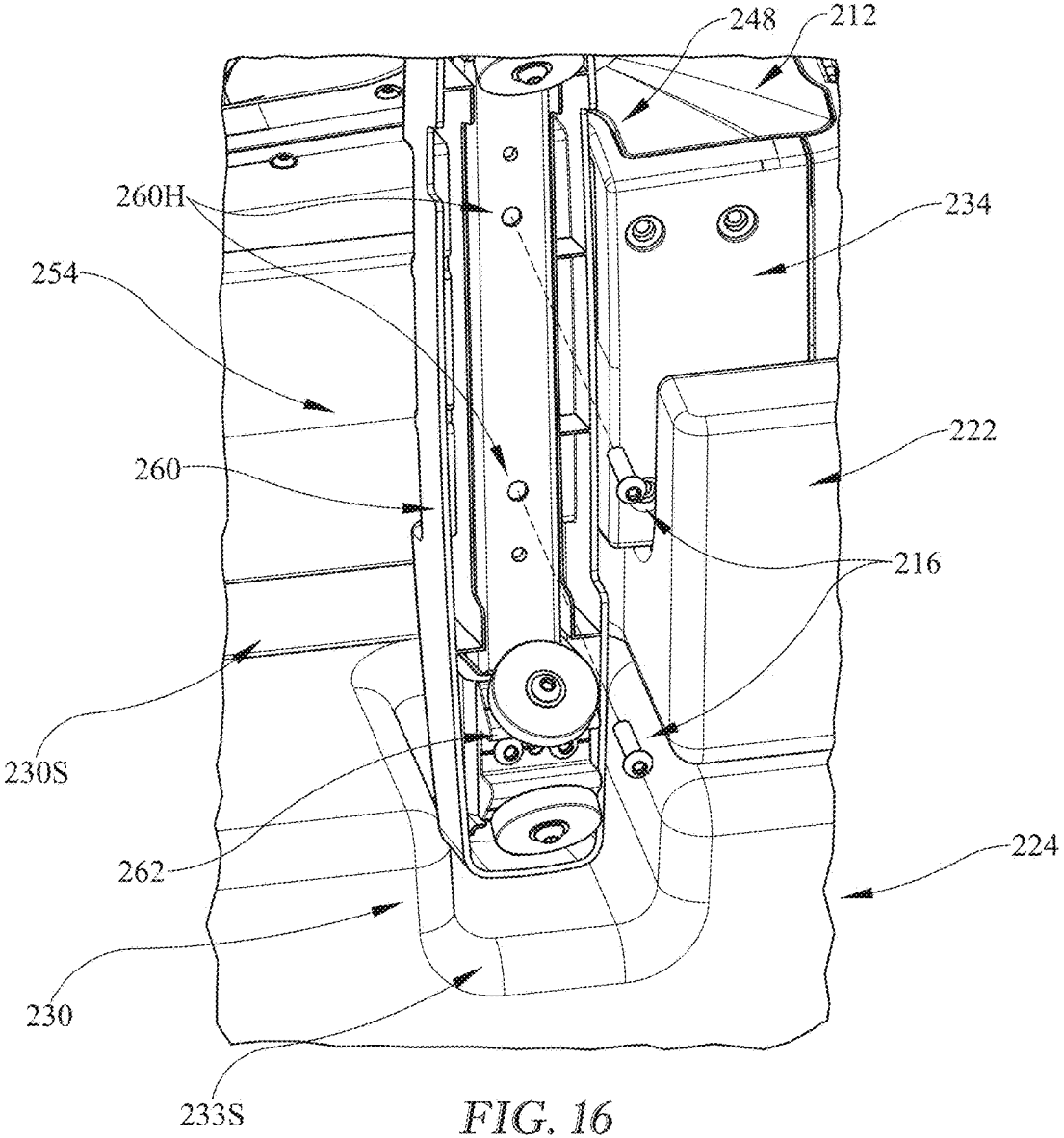
FIG. 16 is a diagrammatic view of the sewing machine kit of FIG. 15 after the second axle is rotated and inserted showing the fasteners are configured to be inserted through the second axle into the sewing-machine base while the second axle is supported in the assembly orientation.

These steps are then repeated for the second axle assembly 254 as shown in FIGS. 15 and 16. The second axle assembly 254 is moved to the assembly orientation so that fastener holes 260H on the second axle assembly 254 are aligned with fastener holes in the second wheel base notch 248 on the sewing-machine base 234 as shown in FIG. 15. The second axle assembly 254 is then inserted into the second wheeled base-receiving space 230 while the second axle assembly 254 is in the assembly orientation so that one end of the second axle assembly 254 is located in the second wheel base cutout 233S as shown in FIG. 15. The fasteners 216 are then inserted into the second axle assembly 254 and the sewing-machine base 234 as shown in FIG. 16.

Figure 17:
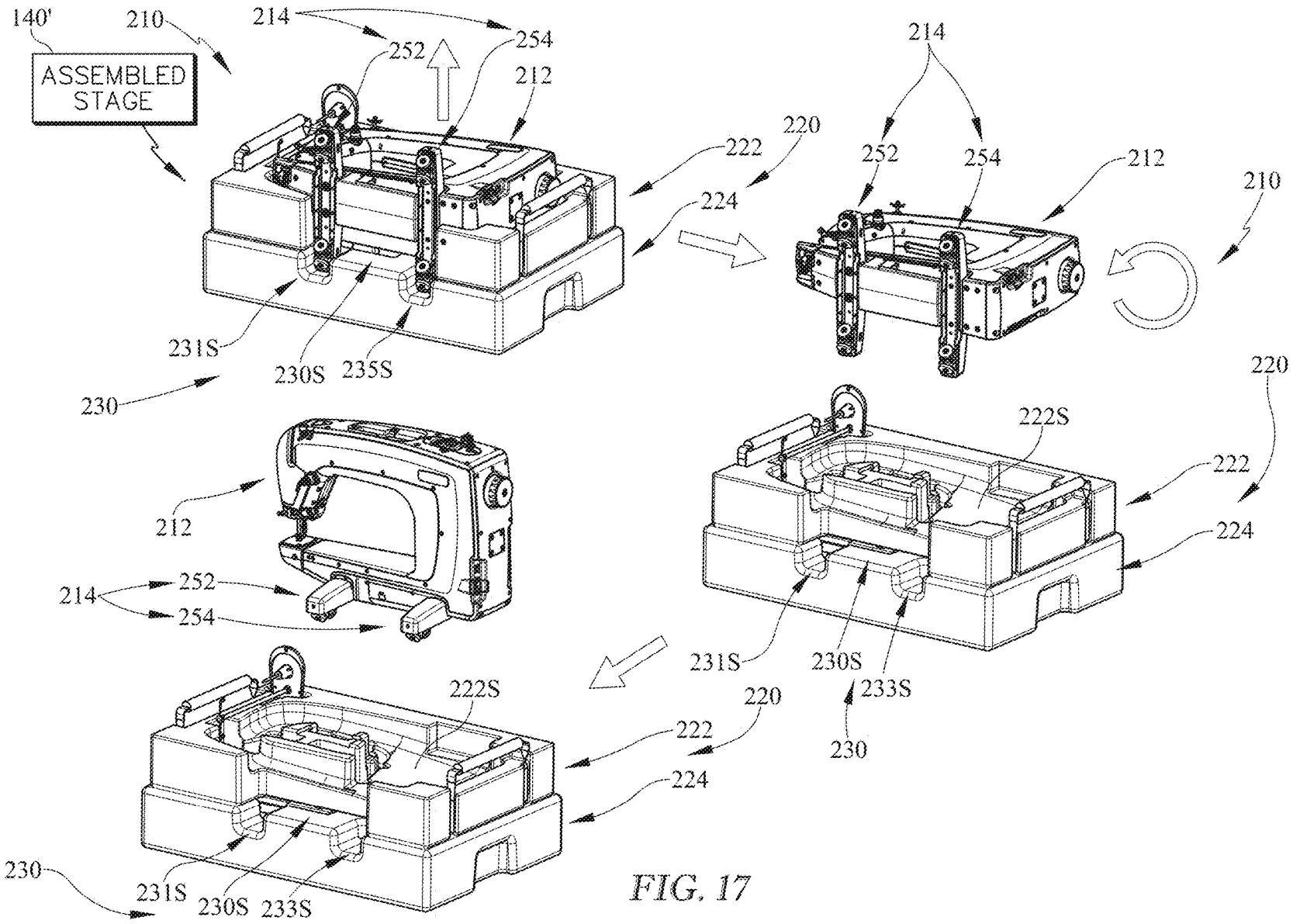
FIG. 17 a diagrammatic view of the sewing machine kit in the assembled stage of the assembling process of FIG. 8 in which the wheeled base is fixed to the sewing machine.

Once the fasteners 216 are inserted, the method 100' moves on to the assembled stage 140' as shown in FIG. 17. In the assembled stage 140', the sewing machine 212 has been fixed to the wheeled base 214. The fasteners 216 are engaged in the fasteners holes in both the sewing-machine base 234 and the wheeled base 214. In the assembled stage, the sewing machine 212 and the wheeled base 214 may be removed from the packaging 220 to position the sewing machine 212 and the wheeled base 214 on the frame assembly.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A sewing machine kit comprising:

a sewing machine including a sewing-machine base, a sewing-machine body coupled to the sewing-machine base, and a sewing-machine head coupled to the sewing-machine body that extends from the sewing-machine body toward the sewing-machine base to define a throat of the sewing machine, a wheeled base configured to be selectively coupled to the sewing-machine base of the sewing machine, a plurality of fasteners configured to selectively couple the wheeled base to the sewing-machine base of the sewing machine, and packaging comprising a first carton having a sewing machine-receiving space configured to receive the sewing machine to support the sewing machine in a packaged orientation in which the sewing-machine body is on its side, a second carton configured to be selectively stacked with the first carton, the second carton having a wheeled base-receiving space configured to receive the wheeled base to support the wheeled base in a packaged orientation in which wheels of the wheeled base are facing downward into the wheeled base-receiving space, and assembly tool means for supporting one of the sewing machine and the wheeled base in an assembly orientation in which fastener holes on the wheeled base are aligned with fastener holes on the sewing-machine base so that a user is permitted to couple the wheeled base to the sewing-machine base with the plurality of fasteners while the one of the sewing machine and the wheeled base are fixed in the assembly orientation.

2. The sewing machine kit of claim 1, wherein the assembly tool means is a portion of the second carton of the packaging formed to define a sewing-machine base-receiving space located within the wheeled base-receiving space and configured to receive a portion of the sewing-machine base to support the sewing machine in the assembly orientation so that the sewing machine and the wheeled base are externally supported to aid the user in coupling the wheeled base to the sewing-machine body with the plurality of fasteners.

3. The sewing machine kit of claim 1, wherein the assembly tool means is a portion of the first carton of the packaging formed to define a first cutout that opens to the sewing-machine base when the sewing-machine base is in the packaged orientation and a portion of the second carton of the packaging formed to define a pair of wheeled base cutouts that align with the first cutout formed in the first carton when the first carton is stacked on top of the second carton and the first cutout and the pair of wheeled base cutouts cooperate to receive the wheeled base to support the wheeled base in the assembly orientation so that the sewing machine and the wheeled base are externally supported to aid the user in coupling the wheeled base to the sewing-machine body with the plurality of fasteners.

4. The sewing machine kit of claim 3, wherein the packaging further includes an insert configured to selectively fit into the first cutout formed in the first carton of the packaging.

5. The sewing machine kit of claim 3, wherein the second carton of the packaging is formed to include locating tabs that extend away from a top surface of the second carton and mate with locating notches formed in the first carton of the packaging when the first carton is stacked on top of the second carton to align the first cutout in the first carton with the pair of wheeled base cutouts formed in the second carton.

6. The sewing machine kit of claim 3, wherein the packaging further includes a pair of handles coupled to opposite sides of the first carton of the packaging and the pair of handles configured to assist the user in stacking the first carton on top of the second carton.

7. The sewing machine kit of claim 1, wherein the wheeled base comprises:

a first axle, a first set of wheels coupled the first axle near opposite ends of the first axle, a second axle spaced apart from the first axle, and a second set of wheels coupled to the second axle near opposite ends of the second axle, wherein the wheeled base-receiving space has a first section configured to receive the first axle and the first set of wheels and a second section spaced apart from the first section and configured to receive the second axle and the second set of wheels.

8. The sewing machine kit of claim 7, wherein the assembly tool means is a portion of the second carton of the packaging formed to define a sewing-machine base-receiving space located within the wheeled base-receiving space and configured to receive a portion of the sewing-machine base to support the sewing machine in the assembly orientation.

9. The sewing machine kit of claim 8, wherein the sewing-machine base-receiving space is located between the first section and the second section of the wheeled base-receiving space.

10. The sewing machine kit of claim 7, wherein the assembly tool means is a portion of the first carton of the packaging formed to define a first cutout and a portion of the second carton of the packaging formed to define a pair of wheeled base cutouts that align with the first cutout formed in the first carton when the first carton is stacked on top of the second carton and the first cutout and the pair of wheeled base cutouts cooperate to receive the wheeled base to support the wheeled base in the assembly orientation.

11. The sewing machine kit of claim 10, wherein the pair of wheeled base cutouts includes a first wheeled base cutout configured to receive one end of the first axle and a second wheeled base cutout configured to receive one end of the second axle.

12. The sewing machine kit of claim 10, wherein the packaging further includes an insert configured to selectively fit into the first cutout formed in the first carton of the packaging.

13. The sewing machine kit of claim 1, wherein one of the first carton and the second carton has a fastener receiving space configured to receive the plurality of fasteners.

14. The sewing machine kit of claim 1, further comprising a hand tool configured to tighten the plurality of fasteners when coupling the wheeled base to the sewing-machine base and one of the first carton and the second carton has a hand tool receiving space configured to receive the hand tool.

15. The sewing machine kit of claim 1, wherein the packaging further includes an outer cover that extends around the first carton and the second carton when the first carton and the second carton are stacked together.

16. A sewing machine kit comprising:

a sewing machine including a sewing-machine base, a sewing-machine body coupled to the sewing-machine base, and a sewing-machine head coupled to the sewing-machine body that extends from the sewing-machine body toward the sewing-machine base to define a throat of the sewing machine, a wheeled base configured to be selectively coupled to the sewing-machine base of the sewing machine, at least one fastener configured to selectively couple the wheeled base to the sewing-machine base of the sewing machine, and packaging comprising a first carton having a sewing machine-receiving space configured to receive the sewing machine to support the sewing machine in a packaged orientation in which the sewing-machine body is on its side, a second carton configured to be selectively stacked with the first carton, the second carton having a wheeled base-receiving space configured to receive the wheeled base to support the wheeled base in a packaged orientation in which wheels of the wheeled base are facing downward into the wheeled base-receiving space and a sewing-machine base-receiving space located within the wheeled base-receiving space, wherein the sewing-machine base-receiving space is configured to receive a portion of the sewing-machine base to support the sewing machine in an assembly orientation in which fastener holes on the wheeled base are aligned with fastener holes on the sewing-machine base so that a user is permitted to couple the wheeled base to the sewing-machine base with the at least one fastener while the sewing machine and the wheeled base are fixed in the assembly orientation.

17. The sewing machine kit of claim 16, wherein the wheeled base comprises:

a first axle, a first set of wheels coupled the first axle near opposite ends of the first axle, a second axle spaced apart from the first axle, and a second set of wheels coupled to the second axle near opposite ends of the second axle, wherein the wheeled base-receiving space has a first section configured to receive the first axle and the first set of wheels and a second section spaced apart from the first section and configured to receive the second axle and the second set of wheels, and wherein the sewing-machine base-receiving space is located between the first section and the second section of the wheeled base-receiving space.

18. A sewing machine kit comprising:

a sewing machine including a sewing-machine base, a sewing-machine body coupled to the sewing-machine base, and a sewing-machine head coupled to the sewing-machine body that extends from the sewing-machine body toward the sewing-machine base to define a throat of the sewing machine, a wheeled base configured to be selectively coupled to the sewing-machine base of the sewing machine, at least one fastener configured to selectively couple the wheeled base to the sewing-machine base of the sewing machine, and packaging comprising a first carton having a sewing machine-receiving space configured to receive the sewing machine to support the sewing machine in a packaged orientation in which the sewing-machine body is on its side and a first cutout that opens to the sewing-machine base when the sewing-machine base is in the packaged orientation, a second carton configured to be selectively stacked with the first carton, the second carton having a wheeled base-receiving space configured to receive the wheeled base to support the wheeled base in a packaged orientation in which wheels of the wheeled base are facing downward into the wheeled base-receiving space and a pair of wheeled base cutouts configured to align with the first cutout formed in the first carton when the first carton is stacked on top of the second carton, wherein the first cutout and the pair of wheeled base cutouts cooperate when the first carton is stacked on top of the second carton to define a second wheeled base-receiving space configured to receive the wheeled base to support the wheeled base in an assembly orientation in which fastener holes on the wheeled base are aligned with fastener holes on the sewing-machine base so that a user is permitted to couple the wheeled base to the sewing-machine base with the at least one fastener while the sewing machine and the wheeled base are fixed in the assembly orientation.

19. The sewing machine kit of claim 18, wherein the packaging further includes an insert configured to selectively fit into the first cutout formed in the first carton of the packaging.

20. The sewing machine kit of claim 18, wherein the wheeled base comprises:

a first axle, a first set of wheels coupled the first axle near opposite ends of the first axle, a second axle spaced apart from the first axle, and a second set of wheels coupled to the second axle near opposite ends of the second axle, wherein the wheeled base-receiving space has a first section configured to receive the first axle and the first set of wheels and a second section spaced apart from the first section and configured to receive the second axle and the second set of wheels.

* * * * *